US010030894B2

(12) United States Patent
Azuma et al.

(10) Patent No.: US 10,030,894 B2
(45) Date of Patent: Jul. 24, 2018

(54) AIR-CONDITIONING APPARATUS

(71) Applicant: Mitsubishi Electric Corporation, Tokyo (JP)

(72) Inventors: Koji Azuma, Tokyo (JP); Hirofumi Koge, Tokyo (JP); Osamu Morimoto, Tokyo (JP); Kensaku Hatanaka, Tokyo (JP); Kazuyoshi Shinozaki, Cypress, CA (US)

(73) Assignee: Mitsubishi Electric Corporation, Tokyo (JP)

( * ) Notice: Subject to any disclaimer, the term of this patent is extended or adjusted under 35 U.S.C. 154(b) by 42 days.

(21) Appl. No.: 15/320,861

(22) PCT Filed: Jul. 13, 2015

(86) PCT No.: PCT/JP2015/070080
§ 371 (c)(1),
(2) Date: Dec. 21, 2016

(87) PCT Pub. No.: WO2016/010006
PCT Pub. Date: Jan. 21, 2016

(65) Prior Publication Data

US 2017/0198945 A1 Jul. 13, 2017

(30) Foreign Application Priority Data

Jul. 14, 2014 (WO) ..... PCT/JP2014/068738

(51) Int. Cl.
*F25B 13/00* (2006.01)
*F25B 47/00* (2006.01)
*F25B 43/00* (2006.01)

(52) U.S. Cl.
CPC ..... *F25B 13/00* (2013.01); *F25B 43/006* (2013.01); *F25B 47/006* (2013.01);
(Continued)

(58) Field of Classification Search
CPC ..... F25B 13/00; F25B 2313/006; F25B 2313/0231; F25B 2313/0233;
(Continued)

(56) References Cited

U.S. PATENT DOCUMENTS

2006/0272342 A1 12/2006 Bash et al.
2011/0197601 A1 8/2011 Booth et al.
(Continued)

FOREIGN PATENT DOCUMENTS

EP 2 650 621 A1 10/2013
JP 06-255356 A 9/1994
(Continued)

OTHER PUBLICATIONS

International Search Report of the International Searching Authority dated Oct. 6, 2015 for the corresponding international application No. PCT/JP2015/070080 (and English translation).

*Primary Examiner* — Marc Norman
(74) *Attorney, Agent, or Firm* — Posz Law Group, PLC

(57) ABSTRACT

An air-conditioning apparatus includes a heat medium system configured to control a flow rate of the heat medium supplied to the heat source unit side heat exchanger that exchanges heat between refrigerant and the heat medium, the heat medium system having at least one system of a heat medium conveyor, a heat medium flow rate adjuster, and a heat medium flow rate control device. In the air-conditioning apparatus, the operation of each of use-side heat exchangers is changed to a cooling operation or a heating operation in accordance with a control command, and a cooling and heating concurrent operation is performed. The refrigerant is caused to flow through the heat source unit side heat exchanger in accordance with the ratio of the total cooling capacity of the use-side heat exchangers to the total heating capacity of the use-side heat exchangers. The heat medium flow rate control device controls the flow rate of the heat
(Continued)

medium supplied to the heat source unit side heat exchanger, using the temperature of the heat medium flowing into the heat source unit side heat exchanger and the temperature of the heat medium flowing from the heat source unit side heat exchanger.

18 Claims, 10 Drawing Sheets

(52) U.S. Cl.
CPC . *F25B 2313/006* (2013.01); *F25B 2313/0231* (2013.01); *F25B 2313/0233* (2013.01); *F25B 2313/0272* (2013.01); *F25B 2313/02741* (2013.01); *F25B 2313/0312* (2013.01); *F25B 2313/0313* (2013.01); *F25B 2313/0314* (2013.01); *F25B 2313/0315* (2013.01)

(58) Field of Classification Search
CPC ..... F25B 2313/0314; F25B 2313/0315; F25B 2600/111; F25B 2600/13
USPC ..... 62/181, 183
See application file for complete search history.

(56) References Cited

U.S. PATENT DOCUMENTS

| | | | |
|---|---|---|---|
| 2012/0078424 | A1 | 3/2012 | Raghavachari |
| 2013/0312443 | A1 | 11/2013 | Tamaki et al. |

FOREIGN PATENT DOCUMENTS

| | | | |
|---|---|---|---|
| JP | 2522361 | B | 5/1996 |
| JP | 2009-198099 | A | 9/2009 |
| JP | 2011-017526 | A | 1/2011 |
| JP | 4832960 | B | 9/2011 |
| JP | 2012-220114 | A | 11/2012 |

FIG. 6

| CONTROLLING STATE OF HEAT MEDIUM FLOW RATE | PATTERN A | PATTERN B | PATTERN C | PATTERN D |
|---|---|---|---|---|
| CONDITIONS | 1. and 2.<br>1. COMPRESSOR OF HEAT SOURCE UNIT IS NOT IN OPERATION<br>2. ALL THE COMPRESSORS OF COMBINATION HEAT SOURCE UNITS ARE NOT IN OPERATION | 1. and 2.<br>1. COMPRESSOR OF HEAT SOURCE UNIT IS NOT IN OPERATION<br>2. AT LEAST ONE COMPRESSOR OF COMBINATION HEAT SOURCE UNITS IS IN OPERATION | 1. and 2.<br>1. COMPRESSOR OF HEAT SOURCE UNIT IS IN OPERATION<br>2. OPERATION TIME OF COMPRESSOR ≥ PREDETERMINED TIME OF PERIOD T0 (5 [min]) | 1. and 2.<br>1. COMPRESSOR OF HEAT SOURCE UNIT IS IN OPERATION<br>2. OPERATION TIME OF COMPRESSOR < PREDETERMINED TIME PERIOD OF T0 (5 [min]) |
| NECESSARY HEAT MEDIUM FLOW RATE SUPPLIED TO HEAT SOURCE UNIT | 0 [$m^3/h$] | LOWER LIMIT FLOW RATE [$m^3/h$] | $dGw = -\beta \times Gw \times (\Delta Tm - \Delta T) / \Delta T$<br>$\Delta T = \lvert Two - Twi \rvert$<br>Gw: HEAT MEDIUM FLOW RATE,<br>dGw: HEAT MEDIUM FLOW RATE CHANGE AMOUNT<br>$\beta$ : GAIN RATIO<br>$\Delta Tm$: HEAT MEDIUM TEMPERATURE DIFFERENCE TARGET VALUE AT HEAT SOURCE UNIT SIDE HEAT EXCHANGER [DEGREES C] = 5 DEGREES C<br>$\Delta T$: HEAT MEDIUM TEMPERATURE DIFFERENCE AT HEAT SOURCE UNIT SIDE HEAT EXCHANGER [DEGREES C]<br>Two: HEAT MEDIUM OUTFLOW TEMPERATURE [DEGREES C]<br>Twi: HEAT MEDIUM INFLOW TEMPERATURE [DEGREES C] | RATED FLOW RATE [$m^3/h$] |
| VOLTAGE OUTPUT VALUE OUTPUTTED TO HEAT MEDIUM FLOW RATE ADJUSTER | 10 [V] | 5 [V] | $dV = \beta \times (Vc - V) / \Delta T \times (\Delta Tm - \Delta T)$<br>V: CURRENT COMMAND VOLTAGE OUTPUTTED TO HEAT MEDIUM FLOW RATE ADJUSTER [V]<br>dV: VOLTAGE CHANGE AMOUNT [V]<br>Vc: VOLTAGE COMMANDING FULL CLOSE [V] = 10 V | 0 [V] |

FIG. 10

| CONTROLLING STATE OF HEAT MEDIUM FLOW RATE | PATTERN A | PATTERN B | PATTERN C-1 | PATTERN C-2 |
|---|---|---|---|---|
| CONDITIONS | 1. and 2.<br>1. COMPRESSOR OF HEAT SOURCE UNIT IS NOT IN OPERATION<br>2. ALL THE COMPRESSORS OF COMBINATION HEAT SOURCE UNITS ARE NOT IN OPERATION | 1. and 2.<br>1. COMPRESSOR OF HEAT SOURCE UNIT IS NOT IN OPERATION<br>2. AT LEAST ONE COMPRESSOR OF COMBINATION HEAT SOURCE UNITS IS IN OPERATION | 1. and 2.<br>1. COMPRESSOR OF HEAT SOURCE UNIT IS IN OPERATION<br>2. OPERATION TIME OF COMPRESSOR ≥ PREDETERMINED TIME PERIOD OF T0 (5 [min]) | 1. and 2.<br>1. COMPRESSOR OF HEAT SOURCE UNIT IS IN OPERATION<br>2. OPERATION TIME OF COMPRESSOR ≥ PREDETERMINED TIME PERIOD OF T0 (5 [min]) |
| NECESSARY HEAT MEDIUM FLOW RATE SUPPLIED TO HEAT SOURCE UNIT | 0 [m³/h] | LOWER LIMIT FLOW RATE [m³/h] | $dGw = -\beta \times Gw \times (\Delta Tm - \Delta T) / \Delta T$<br>$Gw = dGw + Gw$<br>$\Delta T = \lvert Two - Twi \rvert$<br>Gw: HEAT MEDIUM FLOW RATE,<br>dGw: HEAT MEDIUM FLOW RATE CHANGE AMOUNT<br>$\beta$: GAIN RATIO<br>ΔTm: HEAT MEDIUM TEMPERATURE DIFFERENCE TARGET VALUE AT HEAT SOURCE UNIT SIDE HEAT EXCHANGER [DEGREES C] = 5 DEGREES C<br>ΔT: HEAT MEDIUM TEMPERATURE DIFFERENCE AT HEAT SOURCE UNIT SIDE HEAT EXCHANGER [DEGREES C]<br>Two: HEAT MEDIUM OUTFLOW TEMPERATURE [DEGREES C]<br>Twi: HEAT MEDIUM INFLOW TEMPERATURE [DEGREES C] | $Gw = (Gwmax - Gwmin) \times \{(F - Fmin)/(Fmax - Fmin)\} + Gwmin$<br>Gw: HEAT MEDIUM FLOW RATE<br>Gwmax: HEAT MEDIUM RATED FLOW<br>Gwmin: HEAT MEDIUM LOWER LIMIT FLOW RATE<br>F: FREQUENCY OF HEAT SOURCE UNIT<br>Fmax: MAXIMUM FREQUENCY OF HEAT SOURCE UNIT (DETERMINE BY SIZE OF HEAT SOURCE UNIT)<br>Fmin: MINIMUM FREQUENCY OF HEAT SOURCE UNIT (DETERMINE BY SIZE OF HEAT SOURCE UNIT) |
| VOLTAGE OUTPUT VALUE OUTPUTTED TO HEAT MEDIUM FLOW RATE ADJUSTER | 10 [V] | 5 [V] | $dV = \beta \times (Vc - V) / \Delta T \times (\Delta Tm - \Delta T)$<br>V: CURRENT COMMAND VOLTAGE OUTPUTTED TO HEAT MEDIUM FLOW RATE ADJUSTER [V]<br>dV: VOLTAGE CHANGE AMOUNT [V]<br>Vc: VOLTAGE COMMANDING FULL CLOSE [V] = 10 V | $V = (Vo - Vmin) \times (\frac{F - Fmin}{Fmax - Fmin} + Vmin)$<br>V: COMMAND VOLTAGE OUTPUTTED TO HEAT MEDIUM FLOW RATE ADJUSTER [V]<br>Vmin: VOLTAGE COMMANDING HEAT MEDIUM LOWER LIMIT FLOW RATE OUTPUTTED TO HEAT MEDIUM FLOW RATE ADJUSTER [V] (5V)<br>Vo: VOLTAGE COMMANDING FULL OPEN [V] = 0 V<br>*ABOVE EXPRESSION ASSUMES CASE IN WHICH COMMAND VOLTAGE TO HEAT MEDIUM FLOW RATE ADJUSTER IS PROPORTIONAL TO Cv VALUE. |

AIR-CONDITIONING APPARATUS

CROSS REFERENCE TO RELATED APPLICATIONS

This application is a U.S. national stage application of PCT/JP2015/070080 filed on Jul. 13, 2015, which claims priority to International Patent Application No. PCT/JP2014/068738 filed on Jul. 14, 2014, the contents of which are incorporated herein by reference.

TECHNICAL FIELD

The present invention relates to an air-conditioning apparatus that connects indoor units and can selectively perform a heating or cooling operation for each indoor unit or concurrently perform the heating and cooling operations.

BACKGROUND ART

In an air-conditioning apparatus using a conventional refrigeration cycle (heat pump cycle), a heat source equipment side unit (such as heat source equipment or an outdoor unit) including a compressor and a heat source equipment side heat exchanger, a flow rate control device (such as an expansion valve), and a load side unit (such as an indoor unit) including an indoor unit side heat exchanger are connected by refrigerant pipes and constitute a refrigerant circuit through which refrigerant circulates. In the indoor unit side heat exchanger, during evaporation or condensation of the refrigerant, heat is absorbed from or transferred to the air of an air-conditioned space used for heat exchange. Using the phenomenon, the air is conditioned while changing, for example, the pressure and the temperature of the refrigerant circulating through the refrigerant circuit.

For instance, an air-conditioning apparatus capable of performing a cooling and heating concurrent operation (cooling and heating mixed operation) is known (e.g., see Patent Literature 1). When performing the cooling and heating concurrent operation, whether a cooling operation or heating operation is to be performed is automatically determined for each indoor unit in accordance with the setting temperature of the remote controller of the indoor unit and the temperature near the indoor unit, and then the cooling operation or heating operation is performed for each indoor unit.

Moreover, an air-conditioning apparatus is known that determines the target value of the temperature of a heat medium at the outlet of a heat source equipment side heat exchanger, to which the heat medium is supplied, by a predetermined relation, using the frequency of a compressor and the temperature of the heat medium at the inlet of the heat source equipment side heat exchanger, and that controls the frequency of a heat medium conveyor (such as a water pump) in accordance with the target value (e.g., see Patent Literature 2).

CITATION LIST

Patent Literature

Patent Literature 1: Japanese Patent No. 2522361
Patent Literature 2: Japanese Patent No. 4832960

SUMMARY OF INVENTION

Technical Problem

To control the capacity of a heat exchanger, as a conventional way of decreasing conductance (AK value=heat transfer area A[$m^2$]×overall heat transfer coefficient K[$W/m^2$]) that is the heat exchange capacity of the heat exchanger, a refrigerant circuit is proposed that decreases the air quantity of a fan if the heat exchanger is an air heat exchanger, reduces the heat transfer area A by dividing the heat exchange, and performs capacity control by bypassing refrigerant flowing through the heat exchanger.

Moreover, since a heat recovery operation is performed between indoor units in the air-conditioning apparatus capable of performing a cooling and heating mixed operation disclosed in Patent Literature 1, the air conditioning load of a cooling operation and the air conditioning load of a heating operation are substantially equal. Thus, when a full heat recovery operation is performed, the heat exchange amount of an outdoor heat exchanger needs to decrease. That is, to improve comfortability and energy-saving efficiency of the air-conditioning apparatus during the heat recovery operation, for a cooling main operation, a heat dissipation amount needs to approach zero, and for a heating main operation, a heat absorption amount needs to approach zero.

However, because of the reliability of a compressor, a compression ratio needs to be a predetermined value or higher (e.g., 2 or higher). Thus, if the cooling operation is performed with a low-temperature or low-compression operating capacity, the AK value needs to decrease. However, for the air heat exchanger, the air quantity of an outdoor fan needs to be a certain level or higher to cool the electronic board of an outdoor unit, and for a water heat exchanger, a water flow speed needs to be maintained at a certain level or higher to prevent corrosion. Thus, the AK value cannot be decreased to a desired AK value, and the low pressure of a refrigeration cycle decreases. During the cooling operation, the evaporating temperature needs to be zero degrees Celsius or higher to prevent the indoor units from freezing. However, when the low pressure decreases, the operation of the indoor units needs to be stopped to prevent the indoor units from freezing. Thus, the operation of the indoor units frequently starts and stops, having an adverse effect on indoor comfortability and energy-saving efficiency.

Moreover, in the air-conditioning apparatus disclosed in Patent Literature 2, the frequency of a heat medium conveyor is controlled in accordance with the frequency of a compressor. Thus, the frequency of the heat medium conveyor changes, following a transient change at a refrigerant system such as a change in capacity of a use-side heat exchanger, and it takes some time to stabilize the operation of a heat medium system. In a case in which during a cooling and heating mixed operation, the capacity of the use-side heat exchanger is high but the operating capacity of a cooling operation and the operating capacity of a heating operation are equivalent, the flow rate of a heat medium supplied to a heat source equipment side heat exchanger can be decreased. However, the high frequency of the compressor increases the frequency of the heat medium conveyor. Thus, energy-saving efficiency decreases.

In view of these problems, the objective of the present invention is to provide a high-efficiency air-conditioning apparatus that can perform stable control even if there is more than one use-side heat exchanger performing a cooling operation or a heating operation during a cooling and heating concurrent operation performed by circulating refrigerant between a heat source unit side heat exchanger and the use-side heat exchangers and that controls the flow rate of a heat medium supplied to the heat source unit side heat exchanger that exchanges heat with the refrigerant, in accordance with the capacity of the use-side heat exchangers, thereby decreasing power consumed when supplying the heat medium.

Solution to Problem

An air-conditioning apparatus according to an aspect of the present invention includes: a compressor that compresses and discharges refrigerant; a heat source unit side heat exchanger that exchanges heat between the refrigerant and a heat medium different from the refrigerant; use-side heat exchangers that exchange heat between the refrigerant and a usage medium near the refrigerant; a relay unit that is provided between the heat source unit side heat exchanger and the use-side heat exchangers and that changes operation of a part of the use-side heat exchangers to a cooling operation and changes operation of a part of the use-side heat exchangers to a heating operation; and a heat medium system configured to control a flow rate of the heat medium supplied to the heat source unit side heat exchanger, the heat medium system having at least one system of a heat medium conveyor, a heat medium flow rate adjuster, and a heat medium flow rate control device. In the air-conditioning apparatus, the compressor and the heat source unit side heat exchanger are provided in a heat source unit, and the use-side heat exchangers are provided in an indoor unit. The operation of each of the use-side heat exchangers is changed to the cooling operation or the heating operation in accordance with a control command, and a cooling and heating concurrent operation is performed. The refrigerant is caused to flow through the heat source unit side heat exchanger in accordance with the ratio of the total cooling capacity of the use-side heat exchangers to the total heating capacity of the use-side heat exchangers. The heat medium flow rate control device controls the flow rate of the heat medium supplied to the heat source unit side heat exchanger, by controlling the heat medium flow rate adjuster, using the temperature of the heat medium flowing into the heat source unit side heat exchanger and the temperature of the heat medium flowing from the heat source unit side heat exchanger.

Advantageous Effects of Invention

The air-conditioning apparatus according to an aspect of the present invention can maintain comfortability even if there is more than one use-side heat exchanger performing the cooling operation or the heating operation during the cooling and heating concurrent operation. By controlling the flow rate of the heat medium supplied to the heat source unit on the basis of a temperature difference of the heat medium calculated from temperatures of the heat medium detected by the heat medium temperature detecting units of the heat source unit, it is possible to decrease the flow rate of the heat medium in accordance with the capacity of the use-side heat exchangers and to decrease the power consumption of the heat medium conveyor (such as a water pump). Accordingly, this configuration enables high efficient cooling and heating concurrent operation.

BRIEF DESCRIPTION OF DRAWINGS

FIG. 6 illustrates an example of four patterns of the controlling state of the flow rate of the heat medium in Embodiment 2 of the present invention.

FIG. 10 illustrates an example of four patterns of the controlling state of the flow rate of the heat medium in Embodiment 3 of the present invention.

DESCRIPTION OF EMBODIMENTS

Details of the embodiments of the present invention are described below with reference to the drawings.

Embodiment 1

Figure 1:
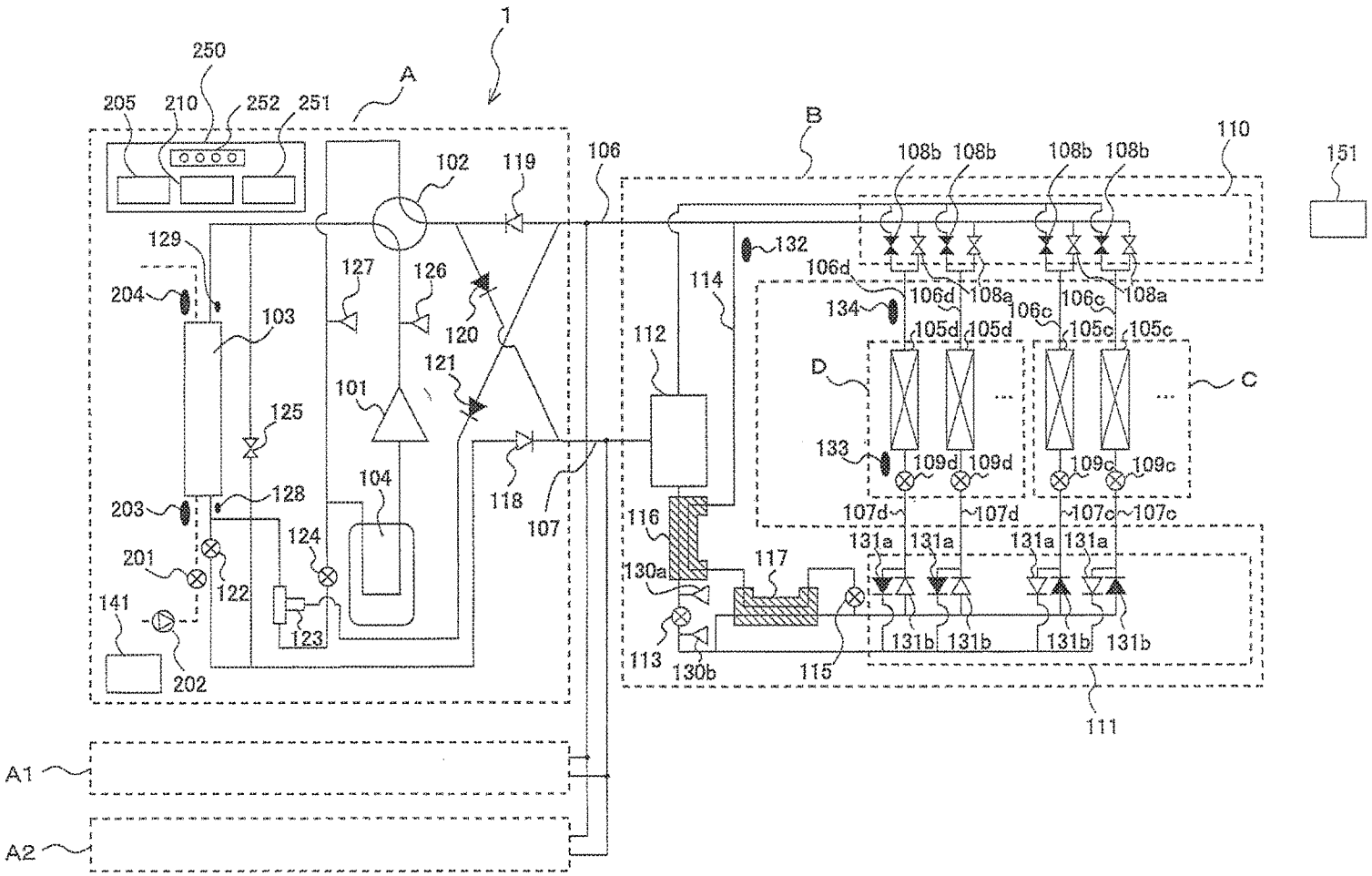
FIG. 1 illustrates a configuration example of an air-conditioning apparatus according to Embodiment 1 of the present invention.

FIG. 1 illustrates a configuration example of an air-conditioning apparatus 1 according to Embodiment 1 of the present invention. As FIG. 1 illustrates, the air-conditioning apparatus 1 includes a heat source unit A, a relay unit B, an indoor unit C, and an indoor unit D, forms a refrigeration cycle for cooling and a refrigeration cycle for heating in the air-conditioning apparatus 1, using, for example, a four-way valve 102 and check valves 118 to 121, and performs a cooling and heating concurrent operation by circulating refrigerant.

If cooling operating capacity and heating operating capacity change during the cooling and heating concurrent operation, pressure detected by a pressure detecting unit 126, pressure detected by a pressure detecting unit 127, the temperature of the heat source unit detected by a temperature detecting unit 128, and the temperature of the heat source unit detected by a temperature detecting unit 129 are controlled in the heat source unit A. Thus, the temperature of refrigerant flowing into use-side heat exchangers 105*c* provided in the indoor unit C and use-side heat exchangers 105*d* provided in the indoor unit D falls within a certain range. It should be noted that the use-side heat exchangers 105*c* and the use-side heat exchangers 105*d* may be collectively referred to as a use-side heat exchanger 105.

Thus, even if the cooling operating capacity and the heating operating capacity change during the cooling and heating concurrent operation, stable cooling and heating operation can be maintained at a low cost.

It should be noted that as the heat source unit, the air-conditioning apparatus 1 may include a heat source unit A1 and a heat source unit A2 that are combination heat source units. The heat source unit A1 and the heat source unit A2 may have the same configuration as the heat source unit A.

Details of the above description are described in order below

In the air-conditioning apparatus 1, the relay unit B is provided between (i) the heat source unit A and (ii) the indoor unit C and the indoor unit D. The heat source unit A and the relay unit B are connected by a first connecting pipe 106 and a second connecting pipe 107 having a smaller pipe diameter than the first connecting pipe 106. The relay unit B and the indoor unit C are connected by third connecting pipes 106*c* and fourth connecting pipes 107*c*. The relay unit B and the indoor unit D are connected by fifth connecting pipes 106*d* and sixth connecting pipes 107*d*. In this connection configuration, the refrigerant flowing between (i) the heat source unit A and (ii) the indoor unit C and the indoor unit D passes through the relay unit B.

It should be noted that the following describes an example in which the number of the heat source units A is one, the number of the relay units B is one, the number of the indoor units C is one, and the number of the indoor units D is one. However, the configuration is not limited to this example. For instance, two or more indoor units may be provided. In another example, two or more heat source units or relay units may be provided.

The heat source unit A includes a compressor 101, the four-way valve 102, a heat source unit side heat exchanger 103, and an accumulator 104. The heat source unit A further includes the check valve 118, the check valve 119, the check valve 120, and the check valve 121. The heat source unit A further includes a fourth flow rate controller 122, a gas-liquid separator 123, a fifth flow rate controller 124, a switching valve 125, and a controller 141. The heat source unit A further includes the first pressure detecting unit 126, the second pressure detecting unit 127, and the temperature detecting unit 128 and the temperature detecting unit 129 provided on the refrigerant inlet side of the heat source unit side heat exchanger 103 or on the refrigerant outlet side of the heat source unit side heat exchanger 103. The heat source unit A provides the controller 141 with pressure and temperatures detected by these units.

The compressor 101 is provided between the four-way valve 102 and the accumulator 104. The compressor 101 compresses and discharges the refrigerant. The discharging side of the compressor 101 is connected to the four-way valve 102, and the suctioning side of the compressor 101 is connected to the accumulator 104.

The four-way valve 102 has four ports, and the ports are respectively connected to the discharging side of the compressor 101, the heat source unit side heat exchanger 103, the accumulator 104, and the outlet side of the check valve 119 and the inlet side of the check valve 120. The four-way valve 102 switches refrigerant flow paths.

One end of the heat source unit side heat exchanger 103 is connected to the four-way valve 102, and the other end of the heat source unit side heat exchanger 103 is connected to a pipe connected to the fourth flow rate controller 122 and the gas-liquid separator 123. The switching valve 125 is an openable and closable valve and is provided in a circuit that bypasses the heat source unit side heat exchanger 103 and the fourth flow rate controller 122.

It should be noted that at the heat source unit side heat exchanger 103, heat is exchanged between the refrigerant flowing through the refrigerant circuit of the heat source unit side heat exchanger 103 and a heat medium different from the refrigerant, such as water or brine.

The accumulator 104 is provided between the four-way valve 102 and the suctioning side of the compressor 101. The accumulator 104 separates liquid refrigerant from gas refrigerant and supplies the gas refrigerant to the compressor 101.

The fifth flow rate controller 124 is provided between the accumulator 104 and the gas-liquid separator 123 and controls the refrigerant flowing into the heat source unit side heat exchanger 103.

The compressor 101, the four-way valve 102, and the heat source unit side heat exchanger 103 described above constitute part of the refrigerant circuit.

The check valve 118 is provided between (i) the fourth flow rate controller 122 connected to the heat source unit side heat exchanger 103 and (ii) the second connecting pipe 107 and the outlet side of the check valve 120. The inlet side of the check valve 118 is connected to a pipe connected to the fourth flow rate controller 122. The outlet side of the check valve 118 is connected to a pipe connected to the second connecting pipe 107 and the outlet side of the check valve 120. Only the refrigerant flowing from the heat source unit side heat exchanger 103 toward the second connecting pipe 107 via the fourth flow rate controller 122 is permitted to flow through the check valve 118.

The check valve 119 is provided between (i) the four-way valve 102 and the inlet side of the check valve 120 and (ii) the first connecting pipe 106 and the inlet side of the check valve 121. The inlet side of the check valve 119 is connected to a pipe connected to the first connecting pipe 106 and the inlet side of the check valve 121. The outlet side of the check valve 119 is connected to a pipe connected to the four-way valve 102 and the inlet side of the check valve 120. The check valve 119 permits only the refrigerant flowing from the first connecting pipe 106 toward the four-way valve 102 to flow.

The check valve 120 is provided between (i) the four-way valve 102 and the outlet side of the check valve 119 and (ii) the outlet side of the check valve 118 and the second connecting pipe 107. The inlet side of the check valve 120 is connected to a pipe connected to the four-way valve 102 and the outlet side of the check valve 119. The outlet side of the check valve 120 is connected to a pipe connected to the outlet side of the check valve 118 and the second connecting pipe 107. The check valve 120 permits only the refrigerant flowing from the four-way valve 102 toward the second connecting pipe 107 to flow.

The check valve 121 is provided between (i) the inlet side of the check valve 119 and the first connecting pipe 106 and (ii) the gas-liquid separator 123 connected to the heat source unit side heat exchanger 103. The inlet side of the check valve 121 is connected to a pipe connected to the inlet side of the check valve 119 and the first connecting pipe 106. The outlet side of the check valve 121 is connected to a pipe connected to the gas-liquid separator 123. The check valve 121 permits only the refrigerant flowing from the first connecting pipe 106 toward the gas-liquid separator 123 to flow.

The check valves 118 to 121 described above constitute the flow path switching valve of the refrigerant circuit. The flow path switching valve and the relay unit B, which is described later, enables formation of the refrigeration cycle for cooling and the refrigeration cycle for heating in the refrigerant circuit during the cooling and heating concurrent operation.

One end of the fourth flow rate controller 122 is connected to the inlet side of the check valve 118, and the other end of the fourth flow rate controller 122 is connected to the heat source unit side heat exchanger 103 and the outlet side of the gas-liquid separator 123. The outlet side of the check valve 118 is connected to one end of the second connecting pipe 107. The other end of the second connecting pipe 107 is connected to the relay unit B.

One end of the switching valve 125 is connected to the heat source unit side heat exchanger 103, and the other end of the switching valve 125 is connected to the fourth flow rate controller 122.

Because of this connection configuration, the fourth flow rate controller 122 and the switching valve 125 are connected in series with the relay unit B, and the refrigerant is supplied to the relay unit B. It should be noted that the fourth flow rate controller 122 is a variable opening degree flow rate control device.

Thus, by adjusting the opening degree of the fourth flow rate controller 122, the amount of the refrigerant flowing into the heat source unit side heat exchanger 103 is controlled. The refrigerant that has passed through the fourth flow rate controller 122 joins the refrigerant that has passed through the switching valve 125, and the joined refrigerant is then supplied to the relay unit B.

The fifth flow rate controller 124 is provided between the gas-liquid separator 123 and the accumulator 104. One end of the fifth flow rate controller 124 is connected to one of the outlets of the gas-liquid separator 123. The other end of the fifth flow rate controller 124 is connected to the inlet side of the accumulator 104. The other outlet of the gas-liquid separator 123 is connected to the heat source unit side heat exchanger 103. The inlet side of the gas-liquid separator 123 is connected to the outlet side of the check valve 121. The inlet side of the check valve 121 is connected to one end of the first connecting pipe 106. The other end of the first connecting pipe 106 is connected to the relay unit B.

Because of this connection configuration, the fifth flow rate controller 124 and the heat source unit side heat exchanger 103 are connected in series with the relay unit B, and the refrigerant is supplied from the relay unit B. It should be noted that the fifth flow rate controller 124 is a variable opening degree flow rate control device.

Thus, the amount of the refrigerant flowing from the relay unit B is controlled by adjusting the opening degree of the fifth flow rate controller 124, and the refrigerant is supplied to the heat source unit side heat exchanger 103 in a state in which the amount of the refrigerant is controlled.

The pressure detecting unit 126 and the pressure detecting unit 127 are, for example, sensors. The first pressure detecting unit 126 measures the pressure of the refrigerant discharged from the compressor 101. The second pressure detecting unit 127 measures the pressure of the refrigerant on the outlet side of the heat source unit side heat exchanger 103 (or on the suctioning side of the compressor 101). These measurement results are provided to the controller 141. The pressure detecting unit 126 and the pressure detecting unit 127 may directly provide the measurement results to the controller 141, or may accumulate measurement results for a certain period and provide the accumulated measurement results to the controller 141 at predetermined periodic intervals.

It should be noted that the pressure detecting unit 126 and the pressure detecting unit 127 may be any devices as long as they can detect the pressure of refrigerant, and the type of device and other details are not particularly limited.

The temperature detecting unit 128 and the temperature detecting unit 129 are, for example, thermistors. The temperature detecting unit 128 and the temperature detecting unit 129 measure the temperature of the refrigerant on the inlet side of the heat source unit side heat exchanger 103 and the temperature of the refrigerant on the outlet side of the heat source unit side heat exchanger 103. It should be noted that the inlet and outlet of the heat source unit side heat exchanger 103 are switched by the operation mode. These measurement results are provided to the controller 141. The temperature detecting unit 128 and the temperature detecting unit 129 may directly provide the measurement results to the controller 141, or may accumulate measurement results for a certain period and provide the accumulated measurement results at predetermined periodic intervals.

It should be noted that in the above description, the temperature detecting unit 128 and the temperature detecting unit 129 are thermistors. However, the temperature detecting unit 128 and the temperature detecting unit 129 are not particularly limited to the thermistors.

A main structural part of the controller 141 is, for example, a microprocessor unit. On the basis of the measurement results obtained by the detecting units, the controller 141 performs integrated control of the heat source unit A and communicates with an external device such as the relay unit B. When the integrated control of the heat source unit A is performed, arithmetic processing necessary for the integrated control is performed.

The relay unit B includes a first branch portion 110, a second branch portion 111, a gas-liquid separator 112, a second flow rate controller 113, a third flow rate controller 115, a first heat exchanger 116, a second heat exchanger 117, a temperature detecting unit 132, a third pressure detecting unit **130*a*, a fourth pressure detecting unit 130*b*, and a controller 151**.

The relay unit B is connected to the heat source unit A via the first connecting pipe 106 and the second connecting pipe 107. The relay unit B is also connected to the indoor unit C via the third connecting pipes **106*c* and the fourth connecting pipes 107*c*. The relay unit B is also connected to the indoor unit D via the fifth connecting pipes 106*d* and the sixth connecting pipes 107*d***.

The first branch portion 110 includes solenoid valves **108*a* and solenoid valves 108*b*. Some of the solenoid valves 108*a* and the solenoid valves 108*b* are connected to the indoor unit C via the third connecting pipes 106*c*. The rest of the solenoid valves 108*a* and the solenoid valves 108*b* are connected to the indoor unit D via the fifth connecting pipes 106*d***.

The solenoid valves **108*a* are openable and closable valves. One end of each of the solenoid valves 108*a* is connected to the first connecting pipe 106. The other end of each of the solenoid valves 108*a* is connected to the third connecting pipe 106*c* and one of the terminals of the solenoid valve 108*b* or the fifth connecting pipe 106*d* and one of the terminals of the solenoid valve 108*b*. The solenoid valves 108*b* are openable and closable valves. One end of each of the solenoid valves 108*b* is connected to the second connecting pipe 107. The other end of each of the solenoid valves 108*b* is connected to the third connecting pipe 106*c* and one of the terminals of the solenoid valve 108*a* or the fifth connecting pipe 106*d* and one of the terminals of the solenoid valve 108*a***.

The first branch portion 110 is connected to the indoor unit C via the third connecting pipes **106*c*. The first branch portion 110 is connected to the indoor unit D via the fifth connecting pipes 106*d*. The first branch portion 110 is connected to the heat source unit A via the first connecting pipe 106 and the second connecting pipe 107. The first branch portion 110 connects the third connecting pipes 106***c* to either the first connecting pipe 106 or the second connecting pipe 107, using the solenoid valves 108*a* and the solenoid valves 108*b*. The first branch portion 110 connects the fifth connecting pipes 106*d* to either the first connecting pipe 106 or the second connecting pipe 107, using the solenoid valves 108*a* and the solenoid valves 108*b*.

Figure 2:
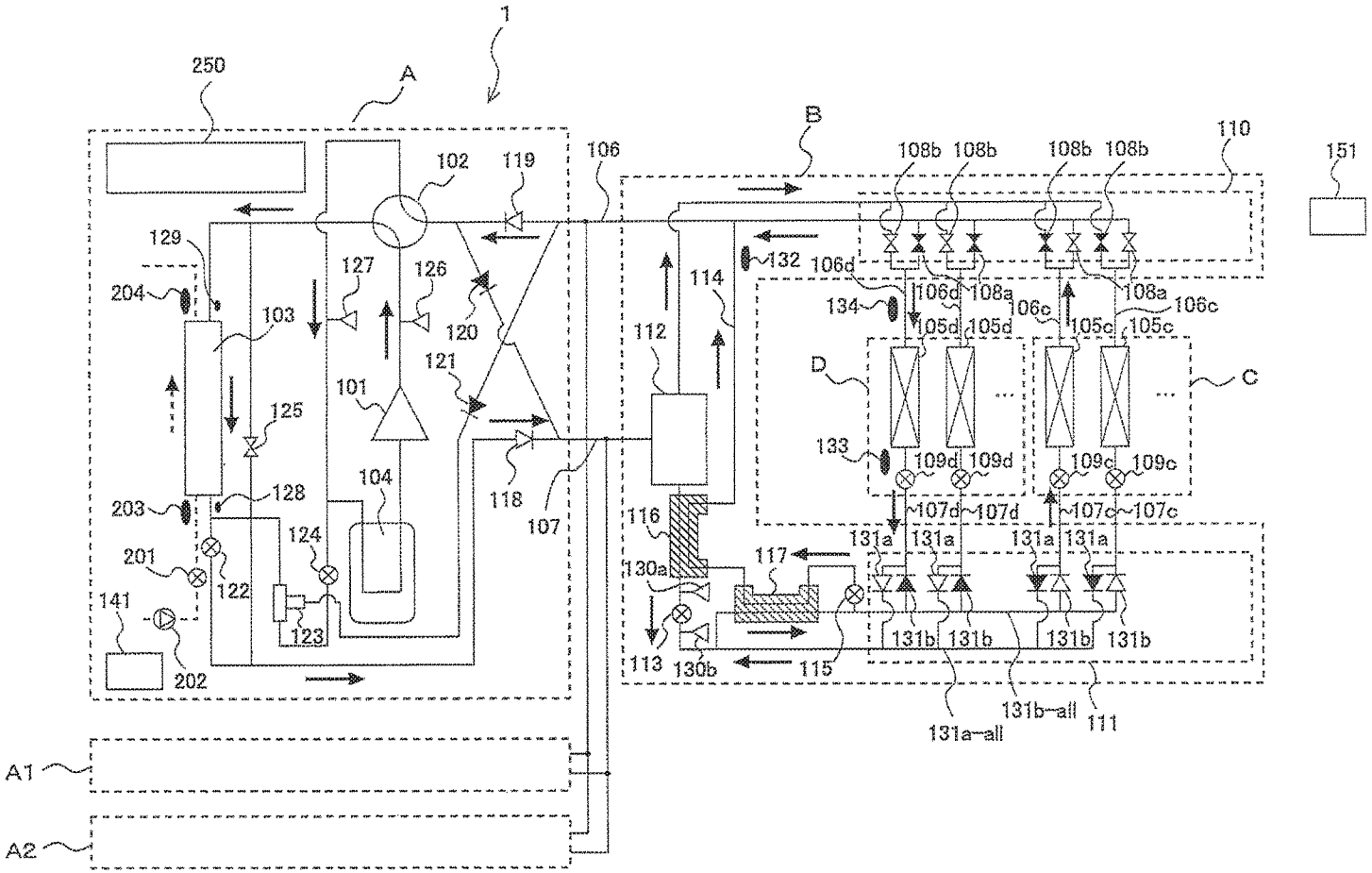
FIG. 2 illustrates a configuration example of the air-conditioning apparatus 1 for illustrating an operating state during a cooling main operation of a cooling and heating concurrent operation in Embodiment 1 of the present invention.
Figure 3:
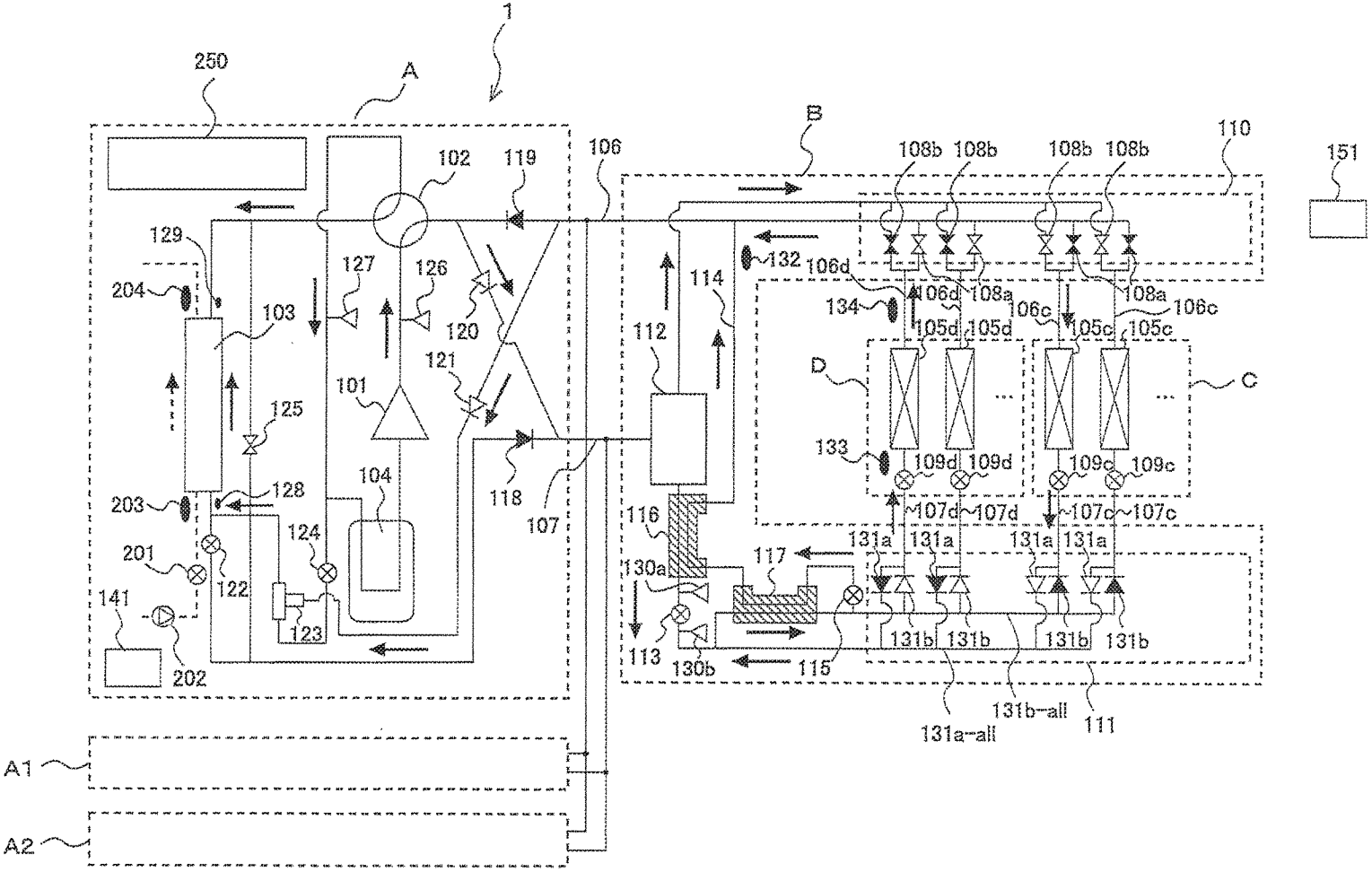
FIG. 3 illustrates a configuration example of the air-conditioning apparatus 1 for illustrating an operating state during a heating main operation of the cooling and heating concurrent operation in Embodiment 1 of the present invention.

The second branch portion 111 includes check valves 131*a* and check valves 131*b*. The check valves 131*a* and the check valves 131*b* are connected in antiparallel. The input sides of the check valve 131*a* and the output sides of the check valves 131*b* are connected to the indoor unit C via the fourth connecting pipes 107*c* and are connected to the indoor unit D via the sixth connecting pipes 107*d*. The output sides of the check valves 131*a* are connected to a merging portion 131*a_all*. The input sides of the check valves 131*b* are connected to a merging portion 131*b_all*. The merging portion 131*a_all* and the merging portion 131*b_all* are illustrated in FIGS. 2 and 3.

The second branch portion 111 is connected to the indoor unit C via the fourth connecting pipes 107*c*. The second branch portion 111 is connected to the indoor unit D via the sixth connecting pipes 107*d*. The second branch portion 111 is connected to the second flow rate controller 113 and the first heat exchanger 116 via the merging portion 131*a_all*. The second branch portion 111 is connected to the third flow rate controller 115 and the first heat exchanger 116 via the merging portion 131*b_all*.

The gas-liquid separator 112 is provided between both ends of the second connecting pipe 107. The gas-phase portion of the gas-liquid separator 112 is connected to the solenoid valves 108*b* of the first branch portion 110. The liquid-phase portion of the gas-liquid separator 112 is connected to the second branch portion 111 via the first heat exchanger 116, the second flow rate controller 113, and the second heat exchanger 117.

One end of the second flow rate controller 113 is connected to the first heat exchanger 116, and the other end of the second flow rate controller 113 is connected to one end of the second heat exchanger 117 and the merging portion 131*a_all* of the second branch portion 111. The third pressure detecting unit 130*a* is provided on a pipe between the first heat exchanger 116 and the second flow rate controller 113. The fourth pressure detecting unit 130*b* is provided on a pipe between (i) the second flow rate controller 113 and (ii) the second heat exchanger 117 and the merging portion 131*a_all*.

The opening degree of the second flow rate controller 113 is adjustable. The opening degree is adjusted so that a difference between a pressure value detected by the third pressure detecting unit 130*a* and a pressure value detected by the fourth pressure detecting unit 130*b* is constant.

One end of the third flow rate controller 115 is connected to a bypass pipe 114 where the second heat exchanger 117 is provided. The other end of the third flow rate controller 115 is connected to a pipe connecting the merging portion 131*b_all* and the second heat exchanger 117. The opening degree of the third flow rate controller 115 is adjustable. The opening degree is adjusted with either one of the temperature detecting unit 132, the third pressure detecting unit 130*a*, and the fourth pressure detecting unit 130*b* or combinations of these units.

One end of the bypass pipe 114 is connected to the first connecting pipe 106, and the other end of the bypass pipe 114 is connected to the third flow rate controller 115.

Thus, the amount of the refrigerant supplied to the heat source unit A changes in accordance with the opening degree of the third flow rate controller 115.

The first heat exchanger 116 is provided between (i) the gas-liquid separator 112 and (ii) the second heat exchanger 117 and the second flow rate controller 113. The first heat exchanger 116 exchanges heat between the bypass pipe 114 and a pipe provided between the gas-liquid separator 112 and the second flow rate controller 113.

The second heat exchanger 117 is provided between the first heat exchanger 116 and one end of the third flow rate controller 115 and between the second flow rate controller 113 and the other end of the third flow rate controller 115. It should be noted that in this case, the other end of the third flow rate controller 115 is connected to the merging portion 131*b_all*. The second heat exchanger 117 exchanges heat between the bypass pipe 114 and a pipe provided between the second flow rate controller 113 and the third flow rate controller 115.

The temperature detecting unit 132 is, for example, a thermistor. The temperature detecting unit 132 measures the temperature of the refrigerant flowing through the pipe provided on the outlet side of the second heat exchanger 117, that is, on the downstream side of the second heat exchanger 117, and provides a measurement result to the controller 151. The temperature detecting unit 132 may directly provide the measurement result to the controller 151, or may accumulate measurement results for a certain period and provide the accumulated measurement results to the controller 151 at predetermined periodic intervals.

It should be noted that in the above description, the temperature detecting unit 132 is a thermistor. However, the temperature detecting unit 132 is not particularly limited to the thermistor.

The third pressure detecting unit 130*a* measures the pressure of the refrigerant flowing through the pipe provided between the first heat exchanger 116 and the second flow rate controller 113, and provides the measurement result to the controller 151.

The fourth pressure detecting unit 130*b* measures the pressure of the refrigerant flowing through the pipe provided between (i) the second flow rate controller 113 and (ii) the second heat exchanger 117 and the second branch portion 111, and provides the measurement result to the controller 151.

It should be noted that the third pressure detecting unit 130*a* and the fourth pressure detecting unit 130*b* are collectively referred to as a pressure detecting unit 130. The pressure detecting unit 130 may directly provide a measurement result to the controller 151, or may accumulate measurement results for a certain period and provide the accumulated measurement results to the controller 151 at predetermined periodic intervals. The pressure detecting unit 130 may be any device as long as it can detect the pressure of refrigerant, and the type of device and other details are not particularly limited.

A main structural part of the controller 151 is, for example, a microprocessor unit. On the basis of, for example, the measurement results obtained by the detecting units, the controller 151 performs control of the relay unit B and communicates with an external device such as the heat source unit A, the indoor unit C, or the indoor unit D. When integrated control of the relay unit B is performed, arithmetic processing necessary for the integrated control is performed.

The indoor unit C includes the use-side heat exchangers 105*c* and first flow rate controllers 109*c*. That is, two or more use-side heat exchangers 105*c* are provided. A liquid pipe temperature detecting unit 133 for detecting the temperature of a pipe is provided between the use-side heat exchanger 105*c* and the first flow rate controller 109*c*. A gas pipe temperature detecting unit 134 for detecting the temperature of a pipe is provided between the use-side heat exchanger 105*c* and the first branch portion 110. It should be noted that because of the size restriction of the sheets of FIGS. 1 to 3, the figures only illustrate the liquid pipe temperature detecting unit 133 and the gas pipe temperature detecting unit 134 for one of the use-side heat exchangers 105*d* in the indoor unit D. However, these temperature detecting units are provided for all of the use-side heat exchangers in the indoor unit C and the indoor unit D.

The use-side heat exchangers 105*c* and the first flow rate controllers 109*c* described above constitute part of the refrigerant circuit.

The indoor unit D includes the use-side heat exchangers 105*d* and first flow rate controllers 109*d*. That is, two or more use-side heat exchangers 105*d* are provided. The liquid pipe temperature detecting units 133 for detecting the temperature of a pipe are provided between the use-side heat exchangers 105*d* and the first flow rate controllers 109*d*. The gas pipe temperature detecting units 134 for detecting the temperature of a pipe are provided between the use-side heat exchangers 105*d* and the first branch portion 110.

The use-side heat exchangers 105*d* and the first flow rate controllers 109*d* described above constitute part of the refrigerant circuit.

A heat medium system provided in the heat source unit A is described below. It should be noted that in Embodiment 1, the heat source unit A includes the heat medium system. However, the entirety or part of the heat medium system may be provided outside the heat source unit A.

The heat medium system supplies, to the heat source unit side heat exchanger 103, a heat medium different from refrigerant such as water or brine used in heat exchange with the refrigerant flowing through the heat source unit side heat exchanger 103. The structural components of the heat medium system are a heat medium flow rate adjuster 201, a heat medium conveyor 202, a heat medium inflow temperature detecting unit 203, a heat medium outflow temperature detecting unit 204, and a heat medium flow rate control device 250. The heat medium system can generally adjust the temperature of the heat medium.

The heat medium flow rate adjuster 201 controls the flow rate of the heat medium flowing through the heat source unit side heat exchanger 103 and is, for example, a valve. The heat medium conveyor 202 sends out the heat medium and is, for example, a pump. The heat medium inflow temperature detecting unit 203 is a temperature sensor for measuring the temperature of the heat medium on the inlet side of the heat source unit side heat exchanger 103. The heat medium outflow temperature detecting unit 204 is a temperature sensor for measuring the temperature of the heat medium on the outlet side of the heat source unit side heat exchanger 103. The heat medium flow rate control device 250 controls the heat medium flow rate adjuster 201 and the heat medium conveyor 202 on the basis of, for example, values detected by the heat medium inflow temperature detecting unit 203 and the heat medium outflow temperature detecting unit 204.

The heat medium flow rate control device 250 includes a heat source unit operation mode detecting unit 205 and an indoor unit operation mode detecting unit 210. The heat source unit operation mode detecting unit 205 determines whether the compressor of the heat source unit A and the compressors of combination heat source units are operating or not. The indoor unit operation mode detecting unit 210 detects the total cooling operating capacity of the indoor unit that is the total capacity of cooling operations of the use-side heat exchangers 105 and the total heating operating capacity of the indoor unit that is the total capacity of heating operations of the use-side heat exchangers 105. The heat medium flow rate control device 250 further includes a heat medium temperature difference arithmetic unit 251 for calculating a difference between a measurement value obtained by the heat medium inflow temperature detecting unit 203 and a measurement value obtained by the heat medium outflow temperature detecting unit 204.

The heat medium flow rate control device 250 calculates the flow rate of the heat medium supplied to the heat source unit side heat exchanger 103, on the basis of the result obtained by the heat medium temperature difference arithmetic unit 251.

The heat medium flow rate control device 250 calculates the flow rate of the heat medium supplied to the heat source unit side heat exchanger 103, also on the basis of the total cooling operating capacity of the indoor unit, the total heating operating capacity of the indoor unit, and the total operating capacity of the heat source unit A and the combination heat source units (heat source unit operating capacity).

The heat medium flow rate control device 250 further includes setting switches 252 with which a heat medium flow rate value can be input.

It should be noted that the heat medium flow rate control device 250 may be included in the controller 141 of the heat source unit A.

FIG. 2 illustrates a configuration example of the air-conditioning apparatus 1 for illustrating an operating state during the cooling main operation of the cooling and heating concurrent operation in Embodiment 1 of the present invention.

As preconditions, the indoor unit C is set to the cooling operation, the indoor unit D is set to the heating operation, and the operation of the air-conditioning apparatus 1 is the cooling main operation.

In the first branch portion 110, the solenoid valves 108*a* connected to the indoor unit C are open, and the solenoid valves 108*a* connected to the indoor unit D are closed. In the first branch portion 110, the solenoid valves 108*b* connected to the indoor unit C are closed, and the solenoid valves 108*b* connected to the indoor unit D are open.

The opening degree of the second flow rate controller 113 is controlled so that a difference between pressure detected by the third pressure detecting unit 103*a* and pressure detected by the fourth pressure detecting unit 130*b* is an appropriate value.

The flow of refrigerant in this case is described below. As the solid-line arrows denote, after the refrigerant is compressed by the compressor 101, high-temperature, high-pressure gas refrigerant is discharged from the compressor 101 and flows into the heat source unit side heat exchanger 103 through the four-way valve 102.

The heat source unit side heat exchanger 103 exchanges heat between the refrigerant and a heat medium such as water. Through the heat exchange, the high-temperature, high-pressure gas refrigerant becomes high-temperature, high-pressure two-phase gas-liquid refrigerant. The high-temperature, high-pressure two-phase gas-liquid refrigerant passes through the fourth flow rate controller 122, the check valve 118, and the second connecting pipe 107 and is supplied to the gas-liquid separator 112 of the relay unit B.

Here, the switching valve 125 is controlled so that the opening degree of the switching valve 125 is a predetermined opening degree, in accordance with a difference between temperature obtained from a pressure value detected by the first pressure detecting unit 126 and a target value of the temperature.

The gas-liquid separator 112 separates the high-temperature, high-pressure two-phase gas-liquid refrigerant into gas-state refrigerant and liquid-state refrigerant.

The gas-state refrigerant flows into the first branch portion 110. After flowing into the first branch portion 110, the gas-state refrigerant flows through the solenoid valves 108*b* that are open and the fifth connecting pipes 106*d* and is supplied to the indoor unit D, which is set to the heating operation.

In the indoor unit D, the use-side heat exchangers 105*d* exchange heat between the gas-state refrigerant and a usage medium such as air, thereby condensing and liquefying the supplied gas-state refrigerant.

The first flow rate controllers 109*d* control the use-side heat exchangers 105*d* on the basis of the degree of subcooling at the outlets of the use-side heat exchangers 1056*d*.

The first flow rate controllers 109*d* decompress the liquid refrigerant obtained by the use-side heat exchangers 105*d* condensing and liquefying the gas-state refrigerant. The liquid refrigerant becomes intermediate-pressure refrigerant. Intermediate pressure is pressure between high pressure and low pressure.

The intermediate-pressure refrigerant flows into the second branch portion 111.

Here, low pressure is applied to the first connecting pipe 106, and high pressure is applied to the second connecting pipe 107. Because of the pressure difference between the first connecting pipe 106 and the second connecting pipe 107, the refrigerant flows into the check valve 118 and the check valve 119, but does not flow into the check valve 120 and the check valve 121.

Meanwhile, the liquid-state refrigerant separated from the gas-state refrigerant b the gas-liquid separator 112 flows into the second branch portion 111 through the second flow rate controller 113, which performs control so that a pressure difference between high pressure and intermediate pressure is constant.

In the second branch portion 111, the supplied liquid-state refrigerant flows into the indoor unit C through the check valve 131*b* connected to the indoor unit C and the fourth connecting pipes 107*c*.

After flowing into the indoor unit C, the liquid-state refrigerant is decompressed and becomes low-pressure refrigerant, using the first flow rate controllers 109*c*, which are controlled in accordance with the degree of superheat at the outlets of the use-side heat exchangers 105*c* of the indoor unit C. In this decompressed state, the liquid-state refrigerant is supplied to the use-side heat exchangers 105*c*.

The use-side heat exchangers 105*c* exchange heat between the supplied liquid-state refrigerant and the usage medium such as air, thereby evaporating and gasifying the liquid-state refrigerant.

The gasified refrigerant becomes gas refrigerant, and the gas refrigerant flows into the first branch portion 110 through the third connecting pipes 106*c*. In the first branch portion 110, the solenoid valves 108*a* connected to the indoor unit C are open. Thus, after flowing into the first branch portion 110, the gas refrigerant flows into the first connecting pipe 106 through the solenoid valves 108*a* connected to the indoor unit C.

The gas refrigerant flows into the check valve 119 with lower pressure than the check valve 121, flows through the four-way valve 102 and the accumulator 104, and is suctioned by the compressor 101.

Through this operation, a refrigeration cycle is formed, and the cooling main operation is performed.

It should be noted that the liquid-state refrigerant separated from the gas-state refrigerant by the gas-liquid separator 112 flows into the second branch portion 111. However, a portion of such liquid-state refrigerant does not flow into the indoor unit C. After passing through the second flow rate controller 113 and the second heat exchanger 117, the portion of the liquid-state refrigerant does not flow into the second branch portion 111, but flows into the third flow rate controller 115. The third flow rate controller 115 decompresses the liquid-state refrigerant so that the refrigerant becomes low-pressure refrigerant, and decreases the evaporating temperature of the refrigerant. When flowing through the bypass pipe 114, the liquid-state refrigerant having a decreased evaporating temperature becomes two-phase gas-liquid refrigerant by the second heat exchanger 117 exchanging heat between the liquid-state refrigerant and the liquid refrigerant mainly supplied from the second flow rate controller 113. The two-phase gas-liquid refrigerant becomes gas refrigerant by the first heat exchanger 116 exchanging heat between the two-phase gas-liquid refrigerant and the high-temperature, high-pressure liquid refrigerant supplied from the gas-liquid separator 112. The gas refrigerant then flows into the first connecting pipe 106.

FIG. 3 illustrates a configuration example of the air-conditioning apparatus 1 for illustrating an operating state during the heating main operation of the cooling and heating concurrent operation in Embodiment 1 of the present invention.

As preconditions, the indoor unit C is set to the heating operation, the indoor unit D is set to the cooling operation, and the operation of the air-conditioning apparatus 1 is the heating main operation.

In the first branch portion 110, the solenoid valves 108*a* connected to the indoor unit C are closed, and the solenoid valves 108*a* connected to the indoor unit D are open. The solenoid valves 108*b* connected to the indoor unit C are open, and the solenoid valves 108*b* connected to the indoor unit D are closed.

The opening degree of the second flow rate controller 113 is controlled so that a difference between pressure detected by the third pressure detecting unit 130*a* and pressure detected by the fourth pressure detecting unit 130*b* is an appropriate value.

The flow of refrigerant in this case is described below. As the thick solid-line arrows denote, the refrigerant is compressed by the compressor 101, and high-temperature, high-pressure gas refrigerant discharged from the compressor 101 passes through the four-way valve 102, the check valve 120, and the second connecting pipe 107 and is supplied to the gas-liquid separator 112 of the relay unit B.

The gas-liquid separator 112 supplies the high-temperature, high-pressure gas refrigerant to the first branch portion 110. The gas refrigerant supplied to the first branch portion 110 flows through the solenoid valves 108*b* that are open and the third connecting pipes 106*c* and is supplied to the indoor unit C, which is set to the heating operation.

In the indoor unit C, the use-side heat exchangers 105*c* exchange heat between the gas refrigerant and a usage medium such as air, thereby condensing and liquefying the supplied gas refrigerant.

The first flow rate controllers 109*c* control the use-side heat exchangers 105*c* on the basis of the degree of subcooling at the outlets of the use-side heat exchangers 105*c*.

The first flow rate controllers 109*c* decompress the liquid refrigerant obtained by the use-side heat exchangers 105*c* condensing and liquefying the gas refrigerant. The liquid refrigerant becomes intermediate-pressure liquid refrigerant. Intermediate pressure is pressure between high pressure and low pressure.

The intermediate-pressure liquid refrigerant flows into the second branch portion 111 through the fourth connecting pipes 107*c*.

After flowing into the second branch portion 111, the liquid refrigerant joins the refrigerant flowing through the merging portion 131*a_all*. The liquid refrigerant that has joined at the merging portion 131*a_all* passes through the second heat exchanger 117. Here, a portion of the liquid refrigerant that has passed through the second heat exchanger 117 ahead of the other portion passes through the third flow rate controller 115 and flows into the second heat exchanger 117 in a decompressed state. Thus, in the second heat exchanger 117, heat is exchanged between the intermediate-pressure liquid refrigerant and low-pressure liquid refrigerant. Since the evaporating temperature of the low-pressure liquid refrigerant is low, the low-pressure liquid refrigerant becomes gas refrigerant and flows into the first connecting pipe 106 through the bypass pipe 114. Meanwhile, the intermediate-pressure liquid refrigerant reaches the merging portion 131*b_all* and flows into the indoor unit D through the check valves 131*b* connected to the indoor unit D and the sixth connecting pipes 107*d*.

After flowing into the indoor unit D, the liquid-state refrigerant is decompressed and becomes low-pressure liquid-state refrigerant, using the first flow rate controllers 109*d*, which are controlled in accordance with the degree of superheat at the outlets of the use-side heat exchangers 105*d* of the indoor unit D. Thus, in a state in which the evaporating temperature of the liquid-state refrigerant is low, the liquid-state refrigerant is supplied to the use-side heat exchangers 105*d*.

The use-side heat exchangers 105*d* exchange heat between the supplied liquid-state refrigerant having a low evaporating temperature and the usage medium such as air, thereby evaporating and gasifying the liquid-state refrigerant.

The gasified refrigerant becomes gas refrigerant, and the gas refrigerant flows into the first branch portion 110 through the fifth connecting pipes 106*d*. In the first branch portion 110, the solenoid valves 108*a* connected to the indoor unit D are open. After flowing into the first branch portion 110, the gas refrigerant flows into the first connecting pipe 106 through the solenoid valves 108*a* connected to the indoor unit D.

The gas refrigerant flows into the check valve 121 with lower pressure than the check valve 119. The liquid refrigerant that has passed through the gas-liquid separator 123 flows into the heat source unit side heat exchanger 103, is evaporated, and becomes gas-state refrigerant. The gas-state refrigerant flows through the four-way valve 102 and accumulator 104 and is suctioned by the compressor 101. The gas refrigerant that has passed through the gas-liquid separator 123 flows through the fifth flow rate controller 124 and the accumulator 104 and is suctioned by the compressor 101.

Through this operation, a refrigeration cycle is formed, and the heating main operation is performed.

Here, low pressure is applied to the first connecting pipe 106, and high pressure is applied to the second connecting pipe 107. Because of the pressure difference between the first connecting pipe 106 and the second connecting pipe 207, the refrigerant flows into the check valve 120 and the check valve 121, but does not flow into the check valve 118 and the check valve 119.

In the above configuration, a case is assumed in which the ratio of the cooling operating capacity to the heating operating capacity changes during the cooling main operation of the cooling and heating concurrent operation.

As the heating operating capacity increases, the quality of the refrigerant needs to be higher as a state of the refrigerant flowing into the relay unit B. Thus, the condensing temperature of the heat source unit side heat exchanger 103 of the heat source unit A, that is, high pressure decreases. Because of this phenomenon, the temperature of a liquid pipe detected by the liquid pipe temperature detecting unit 133 of the indoor unit C performing the cooling operation decreases. This results in repetition of the starting and stopping of the operation of the indoor unit C. Thus, the air-conditioning apparatus 1 cannot perform continuous cooling operation. Moreover, since the condensing temperature is low and heating capacity decreases, users using the air-conditioning apparatus 1 feel uncomfortable.

To prevent the repetition of the starting and stopping of the operation of the indoor unit C, the temperature of the liquid pipe detected by the liquid pipe temperature detecting unit 133 of the indoor unit C needs to be increased to a predetermined value or higher. However, the temperature of the liquid pipe detected by the liquid pipe temperature detecting unit 133 of the indoor unit C is different for each use-side heat exchanger 105*c* of the indoor unit C. Thus, when performing processing of increasing the temperature of the liquid pipe, the temperature of the liquid pipe needs to be individually controlled for each use-side heat exchanger 105*c*. This makes the control complicated.

Moreover, to ensure sufficient heating capacity, the condensing temperature of the heat source unit side heat exchanger 103, that is, high pressure needs to be a predetermined value.

Thus, the amount of the refrigerant flowing through the heat source unit side heat exchanger 103 and the amount of the refrigerant bypassing the heat source unit side heat exchanger 103 via the switching valve 125 are determined by the ratio of the cooling operating capacity (indoor unit C) to the heating operating capacity (indoor unit D).

Figure 4:
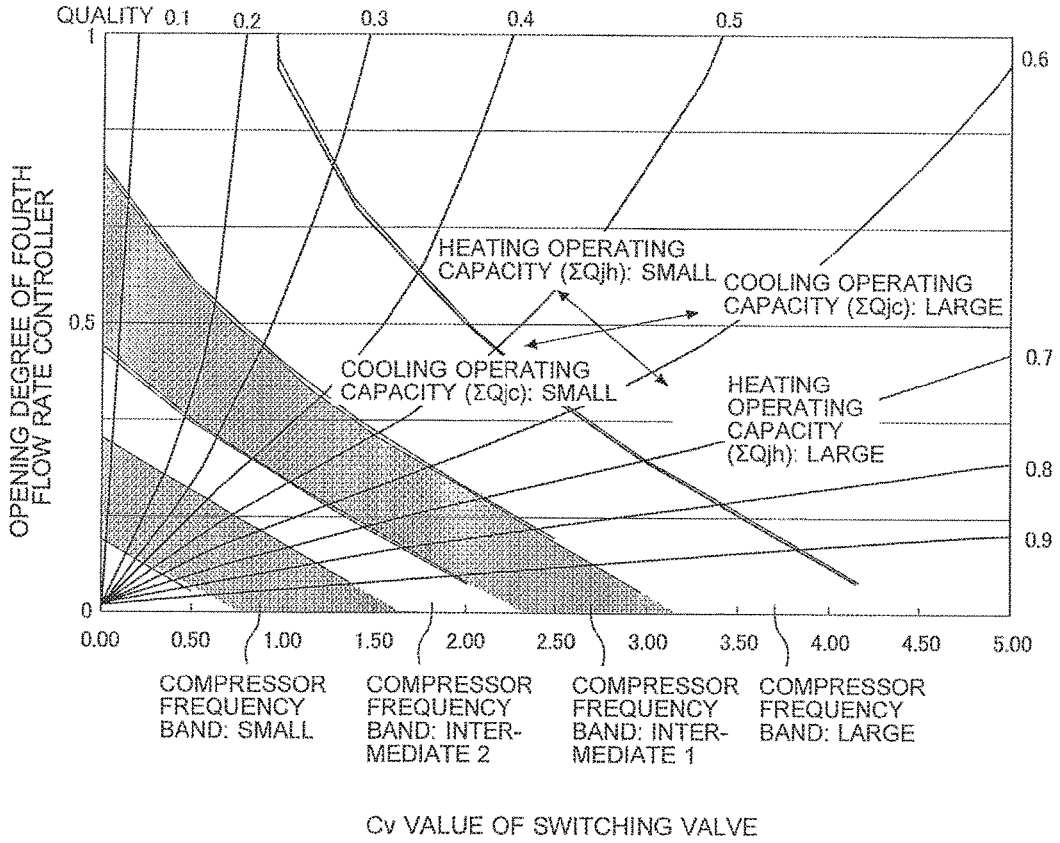
FIG. 4 illustrates an example of a relation of the CV value of a switching valve 125 and the opening degree of a fourth flow rate controller 122 during a cooling operation in Embodiment 1 of the present invention.

FIG. 4 illustrates an example of a relation between a CV value of the switching valve 125 and the opening degree of the fourth flow rate controller 122 during the cooling operation in Embodiment 1 of the present invention.

The horizontal axis denotes the CV value of the switching valve 125, and the vertical axis denotes the opening degree of the fourth flow rate controller 122 for controlling the flow rate of the refrigerant flowing into the heat source unit side heat exchanger 103. ΣQjc is a total heat value during the cooling operation, and ΣQjh is a total heat value during the heating operation.

As FIG. 4 illustrates, during the cooling main operation, when the ratio of the operating capacity of the indoor unit D to the operating capacity of the indoor unit C increases, pressure detected by the first pressure detecting unit 126 decreases. Thus, the quality of the refrigerant needs to increase. When the operating capacity of the indoor unit C and the operating capacity of the indoor unit D are equal, the quality of the refrigerant moves on the same quality line. The frequency of the compressor is determined by the total heat value during the cooling operation ΣQjc, and the CV value of the switching valve 125 is determined by the total heat value during the heating operation ΣQjh.

The opening degree of the fourth flow rate controller 122 is determined by a measurement value obtained by the first pressure detecting unit 126 and measurement values of the refrigerant obtained at the inlet and outlet of the heat source unit side heat exchanger 103 by the temperature detecting unit 128 and the temperature detecting unit 129. In an area with a large amount of the refrigerant flowing through the heat source unit side heat exchanger 103, the degree of subcooling decreases and the quality of the refrigerant at the outlet of the heat source unit side heat exchanger 103 increases. Thus, the characteristic lines for the switching valve 125 are inclined upward toward the right side.

Specifically, in the above case, a difference between a temperature obtained from the pressure detected by the first pressure detecting unit 126 and a target control temperature may be controlled on the basis of the CV value of the switching valve 125, the opening degree of the fourth flow rate controller 122, and the frequency of the compressor 101. This operation eliminates the necessity to individually determine the target control temperature for each of the temperatures of the indoor units, and the target control temperature may be controlled on the basis of the result of the detection by the first pressure detecting unit 126 of the heat source unit A.

This makes the control easy, and stable cooling and heating concurrent operation can be maintained.

It should be noted that the above describes the case in which the operating capacity of the indoor unit increases. However, a case in which the operating capacity of the indoor unit decreases can be also similarly dealt with. Thus, when the operating capacity of the indoor unit D decreases, the temperature detected by the first pressure detecting unit 126 of the heat source unit A increases. That is, processing opposite to the above processing may be performed.

The air-conditioning apparatus 1 includes the switching valve 125, which opens and closes the bypass bypassing the heat source unit side heat exchanger 103 and the fourth flow rate controller 122 for controlling the flow rate of the refrigerant flowing into the heat source unit side heat exchanger 103 of the heat source unit A. The pressure detected by the first pressure detecting unit 126 of the heat source unit A is controlled. Accordingly, even if there is more than one use-side heat exchanger 105 performing the cooling operation or heating operation during the cooling and heating concurrent operation, it is possible to make the stable control easy. Thus, comfortability can be maintained at a low cost.

In Embodiment 1, the air-conditioning apparatus 1 includes the heat source unit side heat exchanger 103, the use-side heat exchangers 105, the relay unit B, the fourth flow rate controller 122, the switching valve 125, and the controller 141. The relay unit B is provided between the heat source unit side heat exchanger 103 and the use-side heat exchangers 105 and changes the operation of a part of the use-side heat exchangers 105 to a cooling operation and changes the operation of a part of the use-side heat exchangers 105 to a heating operation. The fourth flow rate controller 122 controls the flow rate of the refrigerant flowing into the heat source unit side heat exchanger 103. The switching valve 125 is provided in a flow path bypassing the heat source unit side heat exchanger 103. The controller 141 controls the fourth flow rate controller 122 and the switching valve 125. In the air-conditioning apparatus 1, the operation of each of the use-side heat exchangers 105 is changed to the cooling operation or the heating operation, and a cooling and heating concurrent operation is performed. The target control temperature of the heat source unit side heat exchanger 103 is obtained on the basis of pressure at the inlet of the heat source unit side heat exchanger 103 (discharging pressure of the compressor 101), temperatures of the refrigerant at the inlet and outlet of the heat source unit side heat exchanger 103, and the ratio of the cooling operating capacity of the use-side heat exchangers 105 to the heating operating capacity of the use-side heat exchangers 105. The fourth flow rate controller 122 and the switching valve 125 are controlled in accordance with the target control temperature, and the flow rate of the refrigerant supplied to the heat source unit side heat exchanger 103 is controlled. This can make control of performing the cooling operation or heating operation easy even if there is more than one use-side heat exchanger performing the cooling operation during the cooling and heating concurrent operation. Because of this configuration, stable cooling and heating concurrent operation can be maintained at a low cost.

Embodiment 2

Figure 5:
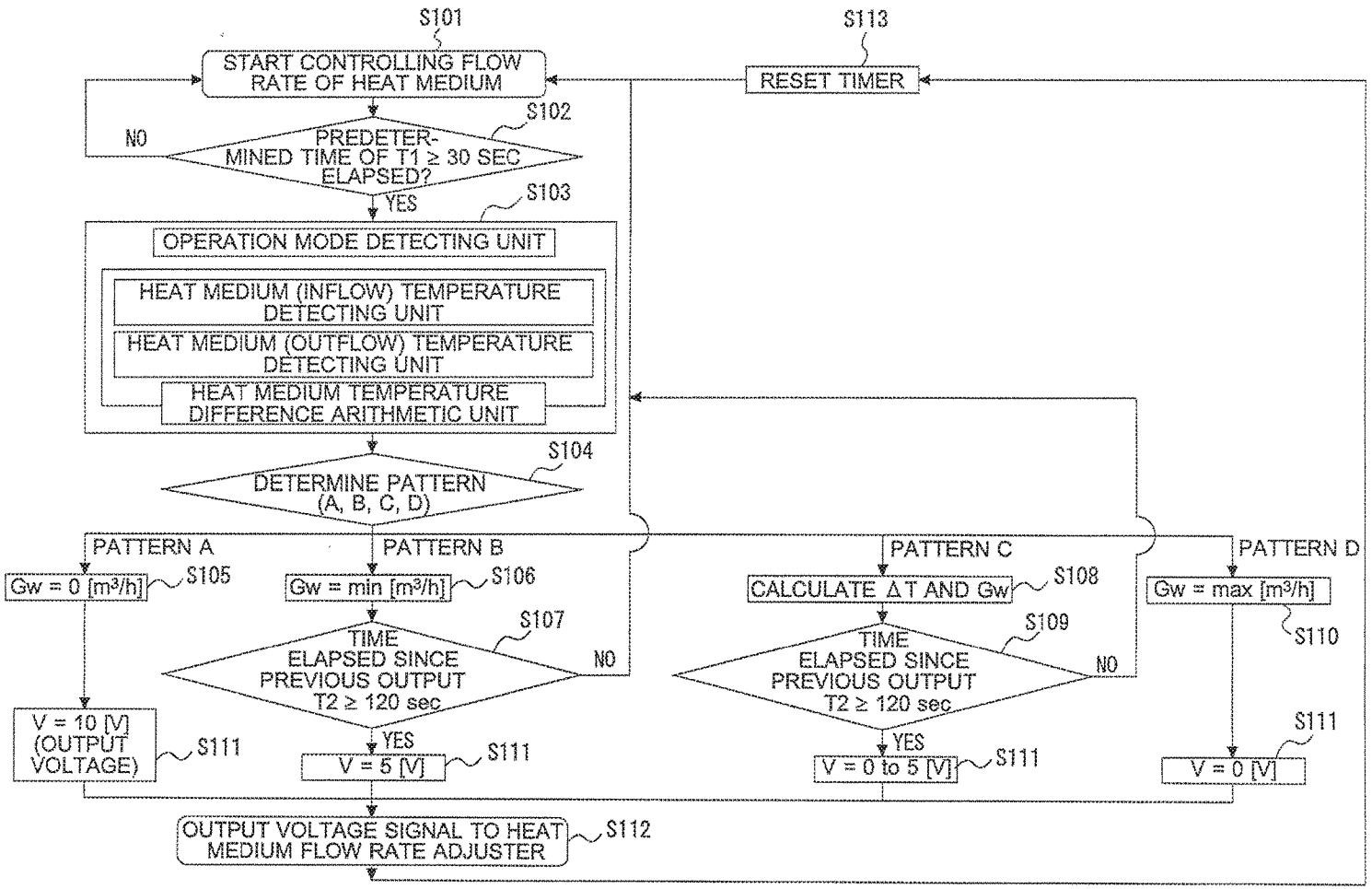
FIG. 5 illustrates an example of a flow chart of the procedure of controlling the flow rate of a heat medium in Embodiment 2 of the present invention.

FIG. 5 is a flow chart illustrating the procedure of controlling the flow rate of a heat medium by the heat medium flow rate control device 250 according to Embodiment 2. With reference to FIG. 5, the following describes procedure from when the heat medium flow rate control device 250 obtains input values until when the heat medium flow rate control device 250 outputs an electric signal to the heat medium flow rate adjuster 201.

When the heat source unit A is ready to operate, controlling of the flow rate of the heat medium starts (step S101). After the controlling of the flow rate of the heat medium starts, whether a preset predetermined time period of T1 seconds (here, 30 seconds) has elapsed is determined (step S102). If the time has elapsed, the procedure continues to the next step, and input values necessary for controlling the flow rate of the heat medium are obtained. As the input values, (i) an operation mode of the heat source unit A detected by the heat source unit operation mode detecting unit 205 (whether or not the compressor 101 is operating) and (ii) a temperature difference of the heat medium obtained by the heat medium temperature difference arithmetic unit 251 on the basis of measurement values obtained by the heat medium inflow temperature detecting unit 203 and the heat medium outflow temperature detecting unit 204 are obtained (step S103). Subsequently, the heat medium flow rate control device 250 determines the pattern (pattern A, B, C, or D) of the controlling state of the flow rate of the heat medium from the operating state of the heat source unit A, using the relations illustrated in FIG. 6 (step S104).

In the pattern A (zero flow rate), the operation of the compressor 101 of the heat source unit A is stopped and the operations of all the compressors of the combination heat source units are stopped. Thus, there is no need to supply the heat medium to (to cause the heat medium to flow through) the heat source unit side heat exchanger 103, and necessary heat medium flow rate Gw is 0 [$m^3$/h] (step S105). After the necessary flow rate of the heat medium is calculated, the calculation result is output to the heat medium flow rate adjuster 201 as an electric signal. Here, a voltage signal falls within a range of 0 to 10 V, and it is assumed that the heat medium flow rate adjuster 201 is fully open at 0 V and is fully closed at 10 V. Thus, 10 V is output (step S111). It should be noted that the heat medium flow rate adjuster 201 may be fully closed at 0 V and may be fully open at 10 V.

However, from the perspective of safety, it is preferable that the heat medium flow rate adjuster 201 be fully open at 0 V and be fully closed at 10 V.

The electric signal may be a current signal instead of the voltage signal described here.

In the pattern B (lower limit flow rate), the operation of the compressor 101 of the heat source unit A is stopped, and at least one compressor of the combination heat source units is operating. Thus, to prevent freezing of the heat source unit side heat exchanger 103 in which the operation of the compressor 101 is stopped, the lower limit flow rate of the heat medium that is a minimum flow rate determined by the heat source unit A is supplied to the heat source unit side heat exchanger 103 (step S106). The calculated necessary flow rate of the heat medium is output to the heat medium flow rate adjuster 201 as an electric signal. Here, a time elapsed since the previous output and a predetermined time period of T2 seconds (here, 120 seconds) are compared in consideration of speed at which the heat medium flow rate adjuster 201 opens and closes. If the time elapsed since the previous output is the predetermined time period of T2 seconds or longer (Yes in step S107), the electric signal is output to the heat medium flow rate adjuster 201. Here, a voltage signal falls within a range of 0 to 10 V, and it is assumed that the heat medium flow rate adjuster 201 is fully open at 0 V and is fully closed at 10 V. Thus, a voltage signal of 0 to 10V is output. However, here, a voltage signal of 5 V is output (step S111). Meanwhile, if the time elapsed since the previous output is shorter than the elapsed time T2 (No in step S107), the procedure goes back to the step in which the controlling of the flow rate of the heat medium is started (step S101), and the procedure is repeated.

In the pattern C (calculated flow rate), the compressor 101 of the heat source unit A is operating and the operation time of the compressor 101 is a predetermined time period of T0 minutes (here, five minutes) or longer. Thus, the necessary flow rate of the heat medium supplied to the heat source unit side heat exchanger 103 is determined by calculating a heat medium flow rate change amount dGw (step S108). It should be noted that the calculated necessary flow rate of the heat medium is output to the heat medium flow rate adjuster 201 as an electric signal. Here, a time elapsed since the previous output and the predetermined time period of T2 seconds (here, 120 seconds) are compared in consideration of the speed at which the heat medium flow rate adjuster 201 opens and closes. If a time elapsed since the previous output is the predetermined time period of T2 seconds or longer (Yes in step S109), the electric signal is output to the heat medium flow rate adjuster 201. Here, a voltage signal falls within a range of 0 to 10 V, and it is assumed that the heat medium flow rate adjuster 201 is fully open at 0 V and is fully closed at 10 V and that the lower limit flow rate of the heat medium is set at 5 V. Thus, a voltage signal of 0 to 5 V is output (step S111). Meanwhile, if the time elapsed since the previous output is shorter than the elapsed time of T2 seconds (No in step S109), the procedure goes back to the step in which the controlling of the flow rate of the heat medium is started (step S101), and the procedure is repeated.

The "heat medium flow rate change amount dGw" calculated in the pattern C is calculated from the expression in FIG. 6 by the heat medium flow rate control device 250, using a temperature difference between the temperature of the heat medium flowing into the heat source unit side heat exchanger 103 and the temperature of the heat medium flowing from the heat source unit side heat exchanger 103 and the target value of the temperature difference. In this expression, the heat medium flow rate Gw denotes a current value. For instance, during transition from the pattern D to the pattern C, the heat medium flow rate Gw is a rated flow.

It should be noted that here, the target value of the heat medium temperature difference is five degrees Celsius. However, the target value of the heat medium temperature difference is determined by the specifications of the heat exchanger and is not limited to five degrees Celsius.

The heat medium flow rate Gw is calculated assuming that even if combination heat sources are included, the number of heat medium flow rate adjusters 201 is one. If the heat source units of the combination heat sources each include the heat medium flow rate adjuster 201, the flow rate of the heat medium of each heat source unit is Gw/n (n=the number of the combination heat sources).

Moreover, gain ratio β in FIG. 6 is set for a gain necessary for an operation in consideration of control intervals. For instance, when the control intervals are two minutes and time constant (amount of refrigerant contained/amount of circulating refrigerant) [seconds] is four minutes or 240 seconds, the gain ratio β at which setting time is the shortest is around 0.19.

In the pattern D (maximum flow rate), the compressor 101 of the heat source unit A is operating and the operation time of the compressor 101 is shorter than the predetermined time period of T0 minutes (here, five minutes). Thus, a starting state of the compressor is assumed, and the rated flow (maximum flow rate) of the heat medium of the heat medium flow rate adjuster 201 is supplied to the heat source unit side heat exchanger 103 (step S110). When the compressor starts operating, pressure inside a refrigerant system is not stable. Thus, the controlling of the flow rate of the heat medium propels a pressure change in the refrigerant system. This leads to a frequent change in the opening degree of the heat medium flow rate adjuster 201, and a pressure change in the heat medium system is likely to be caused. Thus, as a fixed flow rate, a rated flow is set in consideration of an increase of high pressure during the compressor's start up or prevention of freezing of the heat medium heat exchanger. The calculated necessary flow rate of the heat medium is output to the heat medium flow rate adjuster 201 as an electric signal. Here, a voltage signal falls within a range of 0 to 10 V, and it is assumed that the heat medium flow rate adjuster 201 is fully open at 0 V and is fully closed at 10 V. Thus, 0 V is output (step S111).

The necessary flow rate of the heat medium is calculated as described above (steps S105 to S110), the calculated necessary flow rate of the heat medium is then converted into an electric signal output value (step 111), and the signal is output to the heat medium flow rate adjuster 201 (step S112). After the electric signal is output to the heat medium flow rate adjuster 201, a timer that measures a time elapsed since the previous output is reset (step S113). The procedure goes back to the step in which the controlling of the flow rate of the heat medium is started (step S101), and the procedure is repeated.

Figure 7:
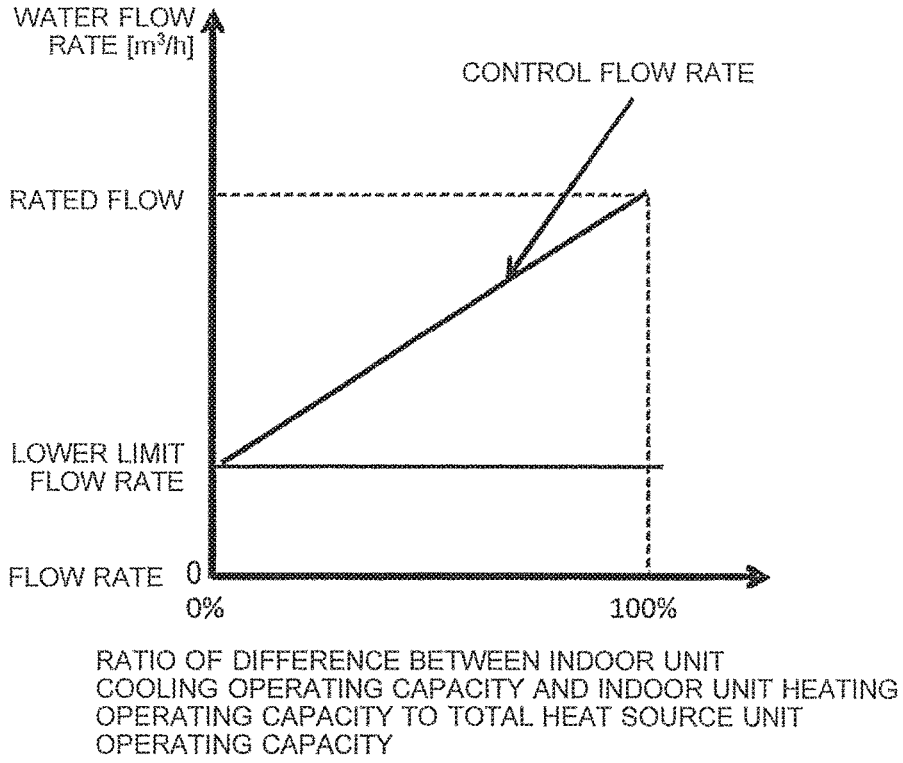
FIG. 7 illustrates an example of a relation of the capacity of use-side heat exchangers and the necessary flow rate of the heat medium supplied to a heat source unit side heat exchanger in Embodiment 2 of the present invention.

The outline of the control performed by the heat medium flow rate control device 250 is illustrated in FIG. 7. That is, the amount of the heat medium supplied to the heat source unit side heat exchanger 103 is zero in the pattern A, a lower limit flow rate specified by the heat source unit A in the pattern B, and an upper limit flow rate corresponding to the rated flow of the heat medium flow rate adjuster 201 in the pattern D. In the pattern C, the amount of the heat medium supplied to the heat source unit side heat exchanger 103 is a flow rate between the lower limit flow rate and the rated flow, which is calculated on the basis of a temperature difference between the temperature of the heat medium at the inlet of the heat source unit side heat exchanger 103 and the temperature of the heat medium at the outlet of the heat source unit side heat exchanger 103 and a target value of the temperature difference. It should be noted that when controlling the flow rate of the heat medium, specific procedure as described below is performed.

The heat medium flow rate control device 250 determines that the lower limit flow rate of the heat medium set by the heat source unit A is the lower limit value and that a flow rate (rated flow) corresponding to the largest opening degree of the heat medium flow rate adjuster 201 is the upper limit value. The heat medium flow rate control device 250 controls the flow rate of the heat medium between the lower limit value and the upper limit value.

It should be noted that preferably, more than one lower limit value is set so that the lower limit value can be selected from among the lower limit values in accordance with the characteristics of the heat medium flow rate adjuster 201. Moreover, the lower limit value is the amount of the heat medium that does not affect the operation of the heat source unit A, and may be selected from among a flow rate required from the perspective of prevention of corrosion of the heat source unit side heat exchanger 103 or a flow rate required from the perspective of prevention of freezing of the heat source unit side heat exchanger 103.

The heat medium flow rate control device 250 may include switches 252 or buttons with which the lower limit value is set. The switches 252 or other devices in this case are not used for changing the lower limit value itself (minimum flow rate), but are used for setting the lower limit value so that the same minimum flow rate is supplied to the heat source unit side heat exchanger 103 even if the specifications (rated Cv value) of the heat medium flow rate adjuster 201 are different.

Preferably, the heat medium flow rate control device 250 controls the heat medium flow rate adjuster 201 so that when the compressor 101 of the heat source unit A starts operating, the maximum flow rate of the heat medium is ensured and after elapse of a predetermined time period, transition to the pattern C (calculated flow rate) is implemented.

It should be noted that from the perspective of swift transition to a stable state of the pattern C or avoidance of forcible opening of the valve of the heat medium flow rate adjuster 201, preferably, the opening degree of the heat medium flow rate adjuster 201 is a little smaller than a maximum opening degree that is a rated opening degree when determining the maximum flow rate of the pattern D.

When the heat source unit A is used in combination with other heat source unit and when the compressor 101 of the heat source unit A is not operating but the compressor of the other heat source unit is operating, it is preferable that the heat medium flow rate control device 250 set the flow rate of the heat medium supplied to the heat medium flow rate adjuster 201 to the lower limit value.

When the heat source unit A is used in combination with other heat source unit and when the compressor 101 of the heat source unit A is not operating and the compressor of the other heat source unit is not operating either, the heat medium flow rate control device 250 sets the flow rate of the heat medium supplied to the heat medium flow rate adjuster 201 to zero.

In the pattern C, when a temperature difference between the temperature of the heat medium on the inlet side of the heat source unit side heat exchanger 103 and the temperature of the heat medium on the outlet side of the heat source unit side heat exchanger 103 is greater than a target temperature difference, the flow rate of the heat medium supplied to the heat medium flow rate adjuster 201 increases.

In the pattern C, in proportion to a difference between the target temperature difference and an actual temperature difference, a change amount of the flow rate of the heat medium supplied to the heat medium flow rate adjuster 201 increases. Here, the target temperature difference is a target difference between the temperature of the heat medium on the inlet side of the heat source unit side heat exchanger 103 and the temperature of the heat medium on the outlet side of the heat source unit side heat exchanger 103.

In the pattern C, when the difference from the target temperature difference between the temperature of the heat medium on the inlet side of the heat source unit side heat exchanger 103 and the temperature of the heat medium on the outlet side of the heat source unit side heat exchanger 103 is a predetermined value or less, the change amount of the flow rate of the heat medium supplied to the heat medium flow rate adjuster 201 is set to zero.

It should be noted that even if communication between the heat medium flow rate control device 250 and the heat medium flow rate adjuster 201 is disconnected, the flow rate of the heat medium supplied to the heat source unit A needs to be ensured. Thus, preferably, when a command electric output value sent to the heat medium flow rate adjuster 201 is large, a small flow rate or the lower limit value is set, and when the command electric output value is small, a large flow rate or the rated flow is set.

By performing the above control processing with the air-conditioning apparatus 1, the flow rate of the heat medium supplied to the heat source unit A is controlled on the basis of the temperature difference of the heat medium calculated from the temperatures detected by the heat medium inflow temperature detecting unit 203 and the heat medium outflow temperature detecting unit 204 of the heat source unit A. This can decrease the flow rate of the heat medium in accordance with the capacity of the use-side heat exchangers and decrease power consumption of the heat medium conveyor 202 (such as water pump) while maintaining comfortability as the air-conditioning apparatus 1. Accordingly, because of this configuration, high efficient cooling and heating concurrent operation can be performed.

Embodiment 3

Figure 8:
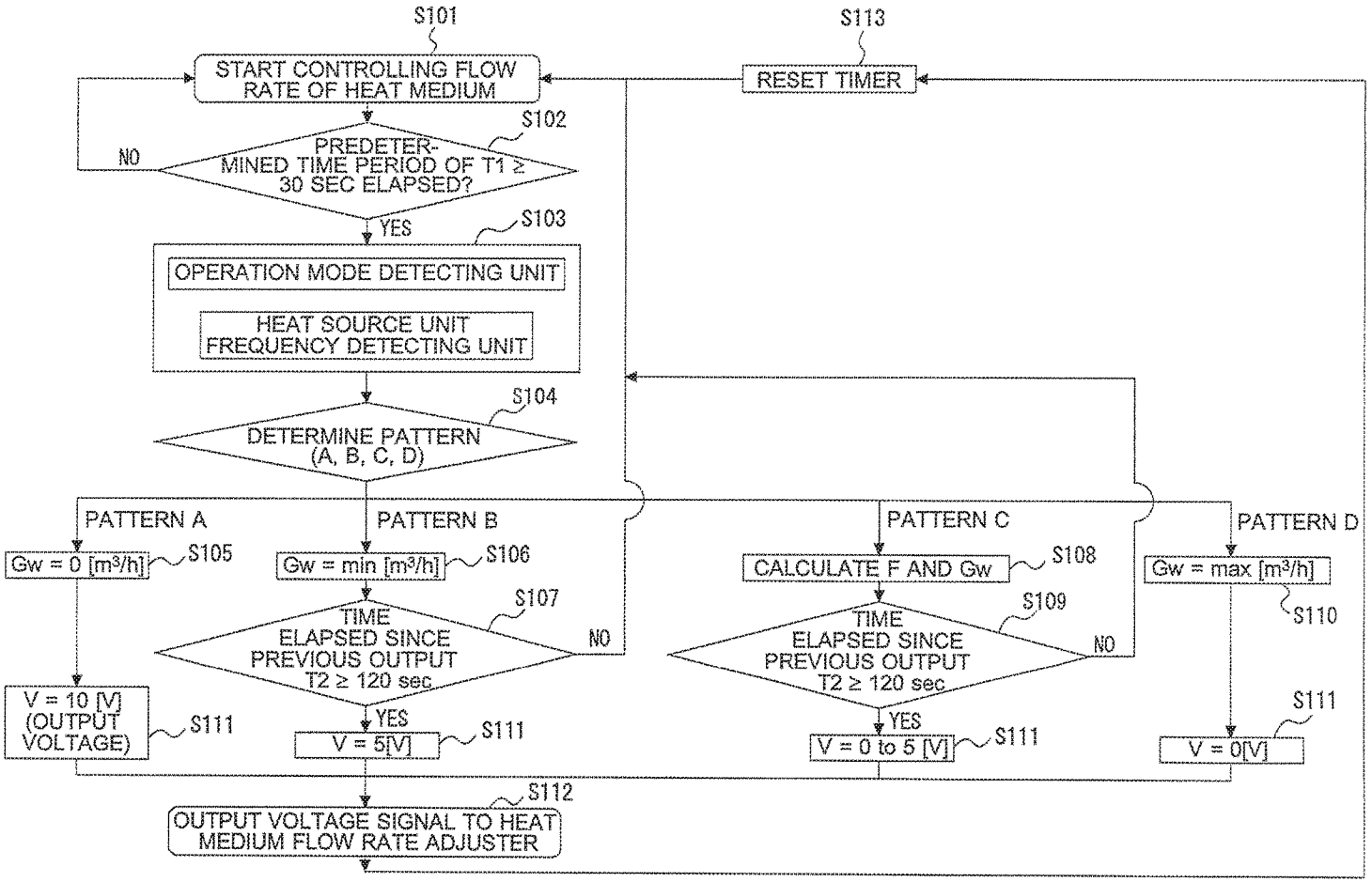
FIG. 8 illustrates an example of a flow chart of the procedure of controlling the flow rate of a heat medium in Embodiment 3 of the present invention.
Figure 9:
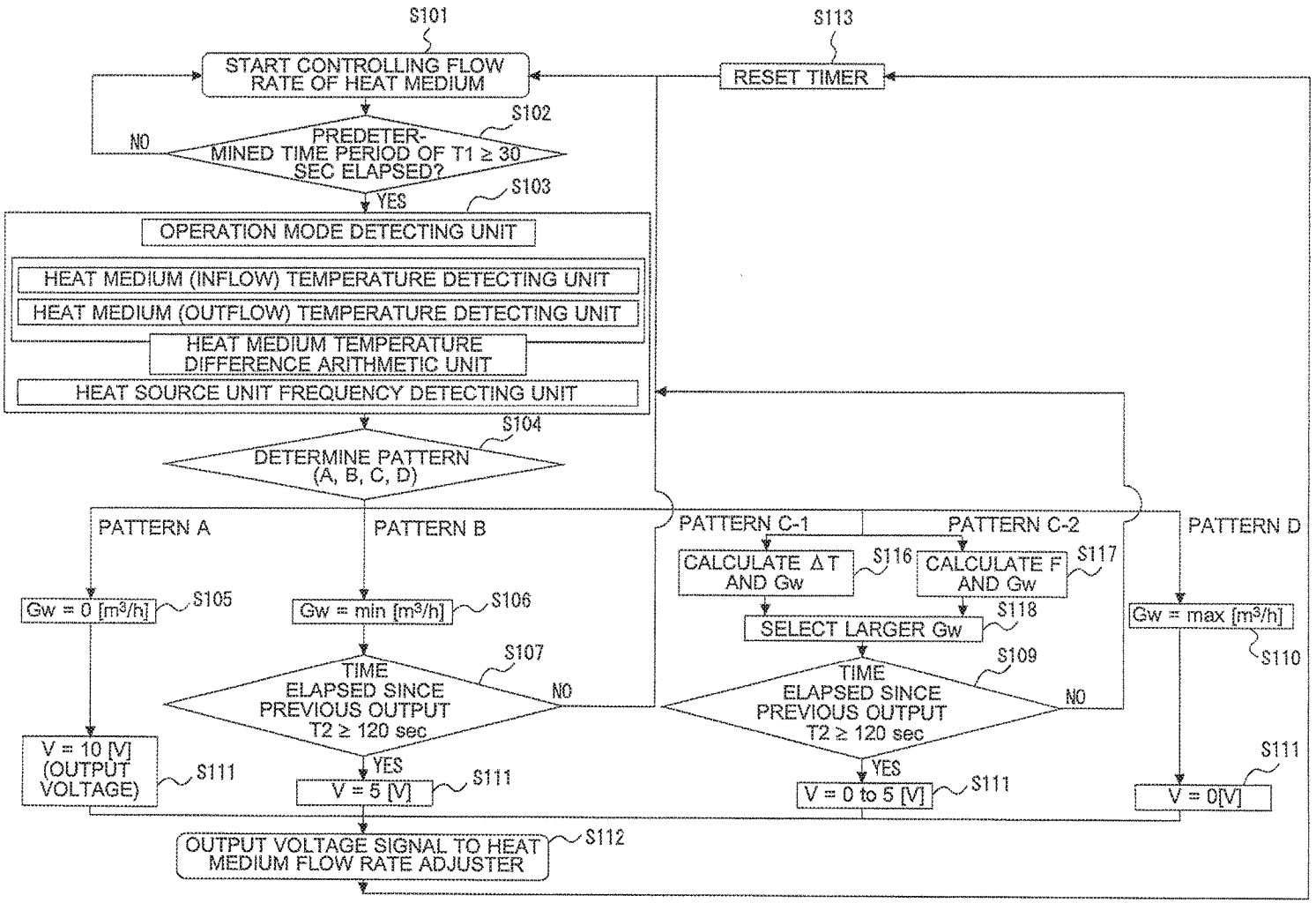
FIG. 9 illustrates another example of the flow chart of the procedure of controlling the flow rate of the heat medium in Embodiment 3 of the present invention.

FIG. 8 is a flow chart illustrating the procedure of controlling the flow rate of a heat medium by the heat medium flow rate control device 250 according to Embodiment 3. FIG. 9 illustrates another example of the flow chart of the procedure of controlling the flow rate of the heat medium in Embodiment 3 of the present invention. FIG. 10 illustrates an example of four patterns of the controlling state of the flow rate of the heat medium in Embodiment 3 of the present invention. Here, since the pattern D is described above, explanation for the pattern D is omitted. Patterns C, C-1, and C-2 (calculated flow rate) are described below with reference to FIGS. 8 to 10. It should be noted that explanation for the same processing as the processing in Embodiment 2 is omitted in Embodiment 3. Moreover, the pattern C in FIG. 8 is the same as the pattern C-2 in FIGS. 9 and 10. The pattern C-1 in FIGS. 9 and 10 are the same as the pattern C in FIGS. 5 and 6.

The pattern C in FIG. 8 is different from the pattern C in FIGS. 5 and 6. In the pattern C here, the heat medium flow rate control device 250 obtains the "heat medium flow rate Gw" from the expression illustrated in the pattern C-2 in FIG. 10 on the basis of a rated flow of the heat medium, the operation frequency of the compressor of the heat source unit A, the maximum frequency of the compressor of the heat source unit A, and the minimum frequency of the compressor of the heat source unit A. When the operation frequency of the compressor of the heat source unit A is greater than the minimum frequency of the compressor of the heat source unit, the heat medium flow rate control device 250 increases the flow rate of the heat medium supplied to the heat medium flow rate adjuster 201.

In FIG. 9, the "heat medium flow rate Gw" is calculated and determined on the basis of a first calculated flow rate in the pattern C-1 and a second calculated flow rate in the pattern C-2 (steps S116 and S117). The first calculated flow rate is calculated using a temperature difference between the temperature of the heat medium flowing into the heat source unit side heat exchanger 103 and the temperature of the heat medium flowing from the heat source unit side heat exchanger 103 and a target value of the temperature difference. The second calculated flow rate is calculated using the operation frequency of the compressor of the heat source unit A, the maximum frequency of the compressor of the heat source unit A, and the minimum frequency of the compressor of the heat source unit A.

In step S116, the first calculated flow rate is calculated on the basis of the temperature difference between the temperature of the heat medium flowing into the heat source unit side heat exchanger 103 and the temperature of the heat medium flowing from the heat source unit side heat exchanger 103 and the target value of the temperature difference. It should be noted that in the pattern C-1, heat medium flow rate Gw'=current heat medium flow rate Gw+change amount dGw.

In step S117, the second calculated flow rate is calculated on the basis of the operation frequency of the compressor of the heat source unit A, the maximum frequency of the compressor of the heat source unit A, and the minimum frequency of the compressor of the heat source unit A. In step S118, the heat medium flow rate control device 250 supplies a larger one of the first calculated flow rate and the second calculated flow rate to the heat medium flow rate adjuster 201.

It should be noted that to suppress a change in flow rate of the quantity of water, the rated flow of the heat medium may have divided ranges represented by Steps, and a typical flow rate may be output for numerical values in the range of each Step. For instance, if the minimum flow rate is 2 $m^3/h$ and the rated flow is 6 $m^3/h$, the output flow rate may be 2 $m^3/h$ for Step 1, 3 $m^3/h$ (2 to 3 $m^3/h$) for Step 2, 4 $m^3/h$ (3 to 4 $m^3/h$) for Step 3, and 5 $m^3/h$ (4 to 5 $m^3/h$) for Step 4.

REFERENCE SIGNS LIST

A heat source unit B relay unit C, D indoor unit 1 air-conditioning apparatus 101 compressor 102 four-way valve 103 heat source unit side heat exchanger 104 accumulator 105, 105*c*, 105*d* use-side heat exchanger 106 first connecting pipe 106*c* third connecting pipe 106*d* fifth connecting pipe 107 second connecting pipe 107*c* fourth connecting pipe 107*d* sixth connecting pipe 108, 108*a*, 108*b* solenoid valve 109, 109*c*, 109*d* first flow rate controller 110 first branch portion 111 second branch portion 112 gas-liquid separator 113 second flow rate controller 114 bypass pipe 115 third flow rate controller 116 first heat exchanger 117 second heat exchanger 118 to 121, 137*a*, 1376*b* check valve 122 fourth flow rate controller 123 gas-liquid separator 124 fifth flow rate controller 125 switching valve 126 first pressure detecting unit 127 second pressure detecting unit 128 inflow temperature detecting unit 129 outflow temperature detecting unit 130*a* third pressure detecting unit 130*b* fourth pressure detecting unit 131*a*, 131*b* check valve 131*a_all*, 131*b_all* merging portion 132 temperature detecting unit 133 liquid pipe temperature detecting unit 134 gas pipe temperature detecting unit 141, 151 controller 201 heat medium flow rate adjuster 202 heat medium conveyor 203 heat medium inflow temperature detecting unit 204 heat medium outflow temperature detecting unit 205 heat source unit operation mode detecting unit 210 indoor unit operation mode detecting unit 250 heat medium flow rate control device 251 heat medium temperature difference arithmetic unit 252 setting switch.

The invention claimed is:

1. An air-conditioning apparatus comprising:

a compressor configured to compress and discharge refrigerant;

a heat source unit side heat exchanger configured to exchange heat between the refrigerant and a heat medium different from the refrigerant;

a plurality of use-side heat exchangers configured to exchange heat between the refrigerant and a usage medium near the refrigerant;

a relay unit provided between the heat source unit side heat exchanger and the plurality of use-side heat exchangers and configured to switch operation of a part of the plurality of use-side heat exchangers to a cooling operation and switch operation of a part of the plurality of use-side heat exchangers to a heating operation; and a heat medium system configured to control a flow rate of the heat medium supplied to the heat source unit side heat exchanger, the heat medium system having at least one system of a heat medium conveyor, a heat medium flow rate adjuster, and a heat medium flow rate control device, the compressor and the heat source unit side heat exchanger being provided in a heat source unit, and the plurality of use-side heat exchangers being provided in an indoor unit, the air-conditioning apparatus performing a cooling and heating concurrent operation in which each of the plurality of use-side heat exchangers is switched to the cooling operation or the heating operation in accordance with a control command, the refrigerant being allowed to flow through the heat source unit side heat exchanger in accordance with a ratio of total cooling capacity of the plurality of use-side heat exchangers to total heating capacity of the plurality of use-side heat exchangers, the heat medium flow rate control device being configured to control the flow rate of the heat medium supplied to the heat source unit side heat exchanger, using temperature of the heat medium flowing into the heat source unit side heat exchanger and temperature of the heat medium flowing from the heat source unit side heat exchanger, the heat medium flow rate control device controlling the flow rate of the heat medium between a lower limit value that is a lower limit flow rate of the heat medium determined by the heat source unit and an upper limit value that is a flow rate corresponding to a maximum opening degree of the heat medium flow rate adjuster, the lower limit value being provided in a plurality so that the lower limit values are selectable in accordance with a characteristic of the heat medium flow rate adjuster.

2. The air-conditioning apparatus of claim 1, wherein the lower limit value is selected from a flow rate that does not affect operation of the heat source unit and at which the heat source unit side heat exchanger is prevented from corroding or a flow rate that does not affect the operation of the heat source unit and at which the heat source unit side heat exchanger is prevented from freezing.

3. The air-conditioning apparatus of claim 1, further comprising a plurality of switches or buttons with which the lower limit value is set.

4. The air-conditioning apparatus of claim 1, wherein the heat medium flow rate control device controls the heat medium flow rate adjuster according to an operation mode of the heat source unit by four patterns:

a zero flow rate at which the heat medium does not flow;

a lower limit flow rate that is a minimum flow rate determined e heat source unit;

a calculated flow rate calculated and determined based on the temperature of the heat medium flowing into the heat source unit side heat exchanger, the temperature of the heat medium flowing from the heat source unit side heat exchanger, and a heat medium temperature difference target value; and a maximum flow rate corresponding to a rated flow of the heat medium flow rate adjuster, the heat medium temperature difference target value being a target difference between the temperature of the heat medium flowing into the heat source unit side heat exchanger and the temperature of the heat medium flowing from the heat source unit side heat exchanger.

5. The air-conditioning apparatus of claim 4, wherein the heat medium flow rate control device controls the heat medium flow rate adjuster so that when the compressor of the heat source unit starts operating, the maximum flow rate is set and after elapse of a predetermined time period, transition to the pattern of the calculated flow rate is implemented.

6. The air-conditioning apparatus of claim 4, wherein when the heat source unit is used in combination with other heat source unit and when the compressor of the heat source unit is not operating while a compressor of the other heat source unit is operating, the heat medium flow rate control device controls the heat medium flow rate adjuster such that a flow rate of the heat medium is set to the lower limit flow rate.

7. The air-conditioning apparatus of claim 4, wherein when the heat source unit is used in combination with at least one of other heat source units and when the compressor of the heat source unit is not operating and a corresponding compressor of the at least one of the other heat source units are not operating either, the heat medium flow rate control device controls the heat medium flow rate adjuster such that a flow rate of the heat medium is set to the zero flow rate.

8. The air-conditioning apparatus of claim 4, wherein in the pattern of the calculated flow rate, when a temperature difference between the temperature of the heat medium flowing into the heat source unit side heat exchanger and the temperature of the heat medium flowing from the heat source unit side heat exchanger is greater than the heat medium temperature difference target value, the heat medium flow rate adjuster is controlled such that a flow rate of the heat medium increases.

9. The air-conditioning apparatus of claim 4, wherein in the pattern of the calculated flow rate, the heat medium flow rate adjuster is controlled such that a change amount of a flow rate of the heat medium increases in proportion to a difference between the heat medium temperature difference target value and an actual temperature difference, the heat medium temperature difference target value being a target difference between the temperature of the heat medium flowing into the heat source unit side heat exchanger and the temperature of the heat medium flowing from the heat source unit side heat exchanger.

10. The air-conditioning apparatus of claim 4, wherein in the pattern of the calculated flow rate, when a difference from the heat medium temperature difference target value is a predetermined value or less, a change amount of a flow rate of the heat medium supplied to the heat medium flow rate adjuster is zero.

11. The air-conditioning apparatus of claim 4, wherein an electric output value of an opening degree command output to the heat medium flow rate adjuster is set so that an output value corresponding to the maximum flow rate is smaller than an output value corresponding to the lower limit flow rate.

12. The air-conditioning apparatus of claim 1, further comprising a heat medium temperature detecting unit provided on a heat medium inlet side of the heat source unit side heat exchanger and configured to detect the temperature of the heat medium and a heat medium temperature detecting unit provided on a heat medium outlet side of the heat source unit side heat exchanger and configured to detect the temperature of the heat medium, wherein the heat medium flow rate control device includes a heat medium temperature difference arithmetic unit configured to obtain a temperature difference between the temperature of the heat medium on the heat medium inlet side and the temperature of the heat medium on the heat medium outlet side based on results detected by the heat medium temperature detecting units.

13. The air-conditioning apparatus of claim 1, wherein the flow rate of the heat medium supplied to the heat source unit side heat exchanger is controlled, using operation frequency of the compressor of the heat source unit, maximum frequency of the compressor of the heat source unit, and minimum frequency of the compressor of the heat source unit.

14. The air-conditioning apparatus of claim 13, wherein the heat medium flow rate control device controls the heat medium flow rate adjuster according to an operation mode of the heat source unit by four patterns:

a zero flow rate at which the heat medium does not flow;

a lower limit flow rate that is a minimum flow rate determined by the heat source unit;

a calculated flow rate calculated and determined based on a first calculated flow rate and a second calculated flow rate; and a maximum flow rate corresponding to a rated flow of the heat medium flow rate adjuster, the first calculated flow rate being calculated based on the temperature of the heat medium flowing into the heat source unit side heat exchanger and the temperature of the heat medium flowing from the heat source unit side heat exchanger, the second calculated flow rate being calculated based on the operation frequency of the compressor of the heat source unit, the maximum frequency of the compressor of the heat source unit, and the minimum frequency of the compressor of the heat source unit.

15. The air-conditioning apparatus of claim 14, wherein in the pattern of the calculated flow rate, the heat medium flow rate control device controls the heat medium flow rate adjuster such that a larger calculated flow rate from one of the first calculated flow rate and the second calculated flow rate is employed.

16. An air-conditioning apparatus comprising:

a compressor configured to compress and discharge refrigerant;

a heat source unit side heat exchanger configured to exchange heat between the refrigerant and a heat medium different from the refrigerant;

a plurality of use-side heat exchangers configured to exchange heat between the refrigerant and a usage medium near the refrigerant;

a relay unit provided between the heat source unit side heat exchanger and the plurality of use-side heat exchangers and configured to switch operation of a part of the plurality of use-side heat exchangers to a cooling operation and switch operation of a part of the plurality of use-side heat exchangers to a heating operation; and a heat medium system configured to control a flow rate of the heat medium supplied to the heat source unit side heat exchanger, the heat medium system having at least one system of a heat medium conveyor, a heat medium flow rate adjuster, and a heat medium flow rate control device, the compressor and the heat source unit side heat exchanger being provided in a heat source unit, and the plurality of use-side heat exchangers being provided in an indoor unit, the air-conditioning apparatus performing a cooling and heating concurrent operation in which each of the plurality of use-side heat exchangers is switched to the cooling operation or the heating operation in accordance with a control command, the flow rate of the heat medium supplied to the heat source unit side heat exchanger being controlled using operation frequency of the compressor of the heat source unit, maximum frequency of the compressor of the heat source unit, and minimum frequency of the compressor of the heat source unit, the heat medium flow rate control device controlling the flow rate of the heat medium between a lower limit value that is a lower limit flow rate of the heat medium determined by the heat source unit and an upper limit value that is a flow rate corresponding to a maximum opening degree of the heat medium flow rate adjuster, the lower limit value being provided in a plurality so that the lower limit values are selectable in accordance with a characteristic of the heat medium flow rate adjuster.

17. An air-conditioning apparatus comprising:

a compressor configured to compress and discharge refrigerant;

a heat source unit side heat exchanger configured to exchange heat between the refrigerant and a heat medium different from the refrigerant;

a plurality of use-side heat exchangers configured to exchange heat between the refrigerant and a usage medium near the refrigerant;

a relay unit provided between the heat source unit side heat exchanger and the plurality of use-side heat exchangers and configured to switch operation of a part of the plurality of use-side heat exchangers to a cooling operation and switch operation of a part of the plurality of use-side heat exchangers to a heating operation; and at least one system of a heat medium conveyor, a heat medium flow rate adjuster, and a heat medium flow rate control device as a heat medium system controlling a flow rate of the heat medium supplied to the heat source unit side heat exchanger, the compressor and the heat source unit side heat exchanger being provided in a heat source unit, and the plurality of use-side heat exchangers being provided in an indoor unit, the air-conditioning apparatus performing a cooling and heating concurrent operation in which each of the plurality of use-side heat exchangers is switched to the cooling operation or the heating operation in accordance with a control command, the flow rate of the heat medium supplied to the heat source unit side heat exchanger being controlled using operation frequency of the compressor of the heat source unit, maximum frequency of the compressor of the heat source unit, and minimum frequency of the compressor of the heat source unit, the heat medium flow rate control device controlling the heat medium flow rate adjuster according to an operation mode of the heat source unit by four patterns:

a zero flow rate at which the heat medium does not flow;

a lower limit flow rate that is a minimum flow rate determined by the heat source unit;

a calculated flow rate calculated and determined based on the operation frequency of the compressor of the heat source unit, the maximum frequency of the compressor of the heat source unit, and the minimum frequency of the compressor of the heat source unit; and a maximum flow rate corresponding to a rated flow of the heat medium flow rate adjuster.

18. The air-conditioning apparatus of claim 17, wherein in the pattern of the calculated flow rate, when the operation frequency of the compressor of the heat source unit is greater than the minimum frequency of the compressor of the heat source unit, the heat medium flow rate control device controls the heat medium flow rate adjuster such that a flow rate of the heat medium increases.

* * * * *